United States Patent [19]

McKim

[11] 4,340,549

[45] Jul. 20, 1982

[54] DUAL INPUT CARBURETOR

[76] Inventor: Robert E. McKim, 1884 Fifth St., Oroville, Calif. 95905

[21] Appl. No.: 248,527

[22] Filed: Mar. 27, 1981

[51] Int. Cl.[3] ..... F02M 7/20

[52] U.S. Cl. ..... 261/144; 123/25 K; 123/25 L; 123/25 N; 123/575; 261/39 A; 261/44 A; 261/39 B; 261/69 R; 261/18 A; 261/18 R; 261/78 R; 261/DIG. 74; 261/26; 261/DIG. 81

[58] Field of Search ..... 261/144, DIG. 67, 39 A, 261/44 A, 39 B, 69 R, 18 A, 18 R, 78 R, DIG. 74, 26, DIG. 81; 123/57 S, 25 K, 25 L, 25 N

[56] References Cited

U.S. PATENT DOCUMENTS

| | | | |
|---|---|---|---|
| 2,214,273 | 9/1940 | Fish | 261/44 A |
| 2,236,595 | 4/1941 | Fish | 261/44 A |
| 2,627,395 | 2/1953 | Rivoche | 261/18 R |
| 2,643,647 | 6/1953 | Meyer et al. | 261/18 R |
| 2,652,237 | 9/1953 | Boller | 261/18 R |
| 2,801,086 | 7/1957 | Fish | 261/44 A |
| 2,996,051 | 8/1961 | Mick | 261/50 A |
| 3,246,886 | 4/1966 | Goodyear et al. | 261/44 A |
| 3,263,974 | 8/1966 | Braun et al. | 261/50 A |
| 3,807,377 | 4/1974 | Hirschler, Jr. et al. | 261/18 R |
| 3,934,571 | 1/1976 | Mennesson | 261/39 A |
| 4,056,087 | 11/1977 | Boyce | 261/18 R |
| 4,181,107 | 1/1980 | Nomura et al. | 261/39 A |
| 4,271,794 | 6/1981 | Knapp et al. | 261/44 A |

*Primary Examiner*—Tim R. Miles

*Attorney, Agent, or Firm*—Graybeal & Uhlir

[57] ABSTRACT

An improved carburetor (20) for delivering one combustible fuel and a liquid, or two combustible fuels from separate reservoirs (50), (500), to the central portion of a hollow spray bar (98) for discharge into carburetor venturi (30) includes substantially closed metering chambers (90), (508) disposed in fuel flow communication from the reservoirs and suspended from opposite ends of spray bar (98). Fuels from metering chambers (90), (500) travel through variable width grooves (154), (548) formed in arcuate metering inserts (148), (544) into the lower end portion of corresponding metering arms (92), (540) and then into the hollow interior of spray bar (98). The orientation of metering chamber (90) is regulated to vary the air-fuel ratio by the cooperative action of a vacuum assembly (200) operating in response to the vacuum level in the engine intake manifold (IM), and by both an engine temperature responsive actuating assembly (302) and an intake manifold temperature responsive actuating assembly (304), thereby achieving maximum fuel efficiency and power while minimizing the generation of air pollutants.

53 Claims, 21 Drawing Figures

DUAL INPUT CARBURETOR

DESCRIPTION

1. Technical Field

This invention relates to carburetors for an internal combustion engine, and more particularly to carburetors capable of alternatively or simultaneously mixing precisely metered quantities of two different types of fuels with air to form a combustible mixture. The present invention also relates to carburetors capable of combining with air a non-combustible liquid, such as water, and a combustible liquid, such as gasoline.

2. Background Art

To satisfactorily vary the quantity of a fuel such as gasoline with air to form a combustible mixture at changing engine temperatures and load levels, known types of carburetors require a multitude of different components and circuits through which the fuel, air and air-fuel mixtures flow. Typically, known types of carburetors include an idle-and-low-speed circuit operating during engine idle and low speeds when the throttle is closed or only slightly open so that only a small volume of slowly flowing air passes through the air horn and throat. The circuit typically includes an air inlet opening above the throttle plate, a fuel inlet opening in communication with a fuel float bowl, and an outlet opening below the throttle valve. The high vacuum below the throttle valve draws air and fuel through the circuit inlet openings for discharge through the outlet. The fuel and air inlets are sized to provide a high proportion of fuel relative to air, which mixture is leaned out slightly by the air passing around the throttle valve.

Known carburetors typically also include a main or high-speed part-load circuit having a main fuel passageway with an inlet at the carburetor float bowl and an outlet at a main nozzle mounted on a venturi located centrally within the throat. The high-speed circuit begins operation when the throttle valve is opened far enough for sufficient quantities of air to flow through the air horn to produce an appreciable vacuum in the venturi to thereby draw fuel from the fuel bowl.

A full-power circuit is incorporated into known types of carburetors to enrich the air-fuel mixture at high speeds and high load situations so that full engine power can be attained. Typical full-power circuits utilize devices which are either vacuum or mechanically operated. With either mode of operation, the enriching device typically includes a metering rod which is adapted to shift longitudinally through a metering-rod jet disposed in the fuel main passageway leading to the main nozzle. The metering rod is usually composed of two different diameter lands or steps to thereby vary the rate at which fuel can pass through the metering rod jet. When the throttle is partly open, the larger diameter portion of the metering rod is disposed within the metering jet. When the throttle is fully open, the metering rod is shifted under vacuum or mechanical action to dispose the smaller diameter portion of the metering rod within the jet to increase the rate at which fuel may flow through the jet thus enriching the air-fuel mixture.

During acceleration, an accelerator pump circuit is utilized to quickly deliver additional fuel to the throat to supply the demand for more fuel created by the sudden inrush of air generated by rapidly opening the throttle. Typically, the accelerator pump circuit includes a plunger or diaphragm which is activated by the throttle linkage to force raw fuel through an accelerator-pump circuit and out a pump jet typically located in the area of the venturi.

Thus, it can be appreciated the known carburetors are composed of numerous different circuits which deliver fuel to the throat from the float bowl. However, it will be appreciated that the flow rate of fuel passing through any of the circuits is typically primarily controlled by the flow rate of air flowing through the air horn and venturi. Consequently, the air-fuel ratio is not adjusted for all throttle settings and through all engine temperature ranges.

Known carburetors also require a choke circuit to provide a very rich fuel mixture to enable the engine to start and satisfactorily run when the engine is cold. When the engine and carburetor are cold, fuel does not vaporize as completely as when these components are warm. The choke system typically includes a choke valve disposed in the air horn upstream from the venturi, which valve is manually or automatically rotated to substantially close off the air horn as the engine is being cranked to thereby create a high vacuum below the valve which is capable of drawing fuel through the main nozzle to thereby compensate for the fact that during cranking, air is drawn through the air horn at very low speeds so that insufficient vacuum is produced in the venturi to draw fuel through the main nozzle. When the engine is operated under cold running conditions, the choke valve is maintained in partially closed position to maintain an enriched air-fuel mixture. During this portion of engine operation, the engine throttle is held in partially open position so that the engine idles faster than when fully warm. The faster idle speed supplies an air-fuel mixture of sufficient quantity and richness to the engine to prevent stalling.

Carburetors of somewhat different construction and operation than the type described above are disclosed by U.S. Pat. Nos. 2,214,273 and 2,236,595 wherein a separate cold start and cold running system is required in addition to a main running system. The cold start system includes a circuit having a fuel inlet at a lower portion of the float bowl and an outlet slightly downstream of the throttle valve. The circuit also includes an air inlet drawing air from a location upstream of the throttle valve. A manually or thermally operated valve opens and closes the idle circuit to regulate the air and fuel flowing through the circuit. The main fuel circuit includes a substantially closed, stationary fuel chamber constructed in the shape of a circle segment connected in fuel flow communication with the fuel float chamber. A fuel arm, depending downwardly from a throttle shaft, is disposed within the fuel chamber to pivot therein. A pair of passageways extend upwardly through the fuel arm, with the passageways having an inlet opening at the bottom of the fuel arm and an outlet at the top of the fuel arm in communication with the hollow interior of the throttle shaft. The throttle shaft includes a series of outlet openings for discharging fuel into the throat. The vacuum action created by air passing by the throttle plate mounted on the throttle shaft dictates whether one or both of the fuel arm passages are utilized to supply fuel to the hollow throttle shaft.

U.S. Pat. No. 2,801,086 concerns another type of carburetor constructed somewhat similarly to the carburetors disclosed in U.S. Pat. Nos. 2,214,273 and 2,236,595, wherein an arcuate groove is formed within one sidewall of the fuel chamber to communicate with a fuel inlet opening formed in the corresponding side of the fuel arm. As in the above-discussed '273 and '595 patents, a fuel passageway extends upwardly through the fuel arm to intersect with the hollow interior of a throttle shaft. The throttle shaft includes a series of outlet openings for discharging fuel into the carburetor throat. Fuel entering into the arm passageway must first pass through the groove formed in the chamber sidewall. Also, an accelerating nozzle interconnects the upper portion of the fuel chamber with the portion of the air horn disposed above the throttle plate. When the fuel arm is rapidly swung through the fuel chamber in response to the rapid opening movement of the throttle plate, raw fuel is forced up to the accelerating nozzle and discharged into the air horn. The carburetor disclosed in the '086 patent does not, however, provide means for adjusting fuel flow in response to the temperature of the engine. Moreover, other than by the change in the velocity of air passing by the fuel discharge holes formed in the throttle shaft, no means are provided for adjusting fuel flow in response to the level of engine load, as reflected by the level of intake manifold vacuum.

DISCLOSURE OF INVENTION

The present invention relates to carburetors for an internal combustion engine which are capable of supplying two different types of fuels either individually or simultaneously in preselected proportions to the engine. Alternatively, one of the fuels can be replaced by water or a mixture of water and a fuel, such as alcohol, for simultaneous induction into the engine with the other fuel. Accordingly, one aspect of the present invention includes a carburetor constructed with first and second fuel/liquid reservoirs for receiving fuel/liquid from separate tanks, and first and second delivery systems for conveying the fuels/liquids from the reservoirs to a hollow spray bar which extends transversely across the throat and is rotatable about its longitudinal axis. The spray bar includes a plurality of fuel discharge openings in communication with the throat, and also supports a throttle valve for rotation within the throat or venturi section.

If two independently combustible fuels are alternatively utilized, the spray bar may be simply formed with one internal passageway having an opening at each end in communication with one of the fuel delivery means. Valves are provided to permit only one of the fuels at a time to flow into the spray bar. This type of construction has the advantage that a relatively volatile fuel, such as gasoline, can be utilized during startup and cold running of the engine. After the engine has sufficiently warmed, a less volatile, but more economical and/or more pollution-free fuel, such as gasohol or alcohol can be utilized.

If the carburetor of the present invention is used to simultaneously induct a combustible fuel, such as gasoline, with a combustible or noncombustible mixture, such as alcohol mixed with water, the spray bar is ideally designed with two independent passageways, each having its own set of outlet openings. One of the passageways is in communication with the pure, combustible fuel, while the other passageway is in communication with the fuel/water mixture. Augmenting the combustible fuel with a combustible fuel/water mixture has been found to provide not only increased fuel economy and reduced pollution emissions, but also higher engine performance without diminishing smoothness of operation or ability to start the engine, especially in cold weather.

If the combustible fuel/water mixture is replaced by pure water or a noncombustible water/fuel mixture, the construction of the spray bar ideally remains the same, with two independent passageways. However, when pure water or a noncombustible water/fuel mixture is used, preferably the liquid is not induced until the engine has at least partially warmed up to thereby avoid difficulty during cold starts and cold running. To this end, the present invention includes a thermally activated switch which prevents liquid flow until the engine has warmed to a predetermined level.

The carburetor of the present invention is designed to vary the proportion of air relative to the two fuels or the proportion of air relative to the pure fuel and the second fuel/water mixture in response to engine temperature, speed and load without requiring the multitude of carburetor circuits and components typically required by conventional carburetors. Accordingly, in another aspect, the present invention utilizes two fuel/liquid delivery systems each including a substantially enclosed fuel metering chamber suspended from an end portion of the spray bar and in connected fuel flow communication with a corresponding fuel reservoir. Each of the fuel metering chambers is constructed with spaced-apart, parallel sidewalls and an arcuate bottom wall curved about a center corresponding to the rotational center of the spray bar. Each fuel/liquid delivery system also includes an elongate metering arm disposed within the metering chamber. The metering arm is securely attached to and depends downwardly from the spray bar to pivot within the metering chamber in response to the pivoting movement of the spray bar. Each metering arm includes an internal passageway having an inlet in its lower end portion in fluid flow communication with the metering chamber and an outlet in its upper end portion in fluid flow communication with a spray bar passageway. In operation, as air flows through the carburetor air horn, a partial vacuum is created in the region of the spray bar outlet openings thereby causing fuel/liquid in the metering chamber to be drawn up through the metering arm and into the spray bar for discharge through the spray bar outlets.

A regulating system is provided for varying the rate of fuel/liquid flowing through each of the metering arms depending on the position of the throttle valve, which in turn is a function of desired engine speed and horsepower output. A metering insert formed with an arcuate metering groove of variable width is insertable within each metering chamber. The arcuate groove is located to lie closely adjacent to and to face the inlet of the metering arm, and is formed along an arc corresponding to the arc swept by the metering arm inlet. Thus, as the metering arm pivots within a corresponding chamber in response to the movement of the spray bar and the throttle valve, the width of the metering insert groove addressing the metering arm passageway inlet varies in response to the angular position of the metering arm. Since fuel/liquid entering into the metering arm inlet first passes through the metering insert groove, the rate of entry of the fuel/liquid varies with the width of the portion of the groove addressing the metering arm and thus varies with the angular position of the metering arm. This construction enables not only the flow rate of fuel/liquid to be continuously varied and precisely controlled in response to the throttle opening position, but also by replacing the metering insert with another having a groove of a different width or taper, the carburetor may be closely matched with different sizes and types of engines.

The carburetors of the present invention also utilize a vacuum diaphragm assembly to regulate the air-fuel mixture. The diaphragm assembly is interconnected in air flow communication with the intake manifold to sense the vacuum level therein. The vacuum assembly includes an actuating rod interconnected with a fuel metering chamber to thereby pivot the metering chamber about the spray bar and relative to its corresponding metering arm in response to changes in inlet manifold vacuum level. As a consequence, the flow rate of fuel flow through the carburetor is responsive to loads imposed on the engine.

In an additional fuel flow regulating means, the rate of fuel supplied to the engine by the carburetor of the present invention is controlled in part by the temperature of the engine as measured by both the temperature of the engine coolant and the temperature of the intake manifold. This thermally responsive fuel flow regulating means includes a cam mounted on a rotatable control rod, with the cam bearing against one end of a pivoting scissors linkage assembly having its opposite end connected to the actuating rod of the vacuum diaphragm assembly. A first temperature responsive actuating assembly, interconnected with the control rod, is positioned to sense engine coolant liquid temperature and rotate the control rod and the cam in response thereto. The position of the cam not only affects the angular position of the fuel chamber, but also governs the extent to which the vacuum diaphragm assembly may pivot the fuel chamber. A second temperature responsive actuating assembly, adapted to sense intake manifold temperature, is also interconnected with the control rod in a manner enabling the assembly to rotate the rod and cam in response to the intake manifold temperature. During cold start and initial engine running, the thermally activated fuel flow regulating system controls the position of the fuel metering chamber relative to the fuel metering arm to provide an enriched air-fuel mixture to compensate for the fact that while the engine is cold, gasoline and other fuels vaporize very poorly.

According to another aspect of the present invention, means are provided to temporarily increase the flow of fuel or fuel-water mixture up through the metering arms in response to the speed in which the arms are swung through their metering chambers by the rate of rotation of the spray bar. When the throttle is suddenly opened to quickly gain additional power, such as during acceleration, because of its relatively light mass, the speed of the air passing through the air horn increases much more rapidly than the speed of the fuel passing through the metering arm. To compensate for this, the lower end portion of the fuel metering arm is formed with a pressure block circuit having at least one opening in the side of the arm facing the direction of travel of the arm as it swings toward the wider end of the metering groove. The pressure block circuit also includes at least one outlet opening disposed alongside the metering arm passageway inlet, with the outlet opening on the side of the passageway inlet opposite the wider end portion of the metering groove. Thus, as the metering arm swings in a direction towards the wider end portion of the groove, fuel within the metering chamber enters the pressure block circuit opening and exits the pressure block circuit outlet to thereby supply fuel at elevated pressure to the metering arm passageway inlet opening thus increasing the flow rate of fuel up through the metering arm.

According to a further aspect of the present invention, the portion of the carburetor throat disposed downstream of the throttle valve is contoured to continuously vary in cross-sectional shape while remaining constant in total cross-sectional area. In cross-section, the throat sequentially transitions into a plurality of oblong sections spaced along its length, with adjacently located oblong sections being disposed transversely to each other. The air-fuel mixture is turbulated as it passes through the throat so that a uniform mixture is achieved prior to entering the intake manifold.

According to one more aspect of the present invention, the carburetor is heated to a predetermined maximum temperature by the engine coolant. To this end, the carburetor includes a body portion composed of a plurality of internal passageways disposed in fluid flow communication with both a first engine coolant source corresponding to approximately the hottest portion of the engine cooling liquid and a second engine coolant source corresponding to approximately the coolest portion of the engine coolant liquid. A mixing valve varies the proportion of engine coolant from the first and second sources which is allowed to flow through the carburetor passageways thereby limiting the maximum temperature of such coolant.

In still another aspect of the present invention, circulating means are provided for continuing the circulation of engine coolant liquid through the carburetor internal passageways if after the engine has ceased operation the temperature of the coolant within the carburetor rises reaching a preselected level. Continuing to circulate the coolant after engine shutdown prevents the fuel in the carburetor from boiling. As a result, hot flooding of the carburetor is minimized.

BRIEF DESCRIPTION OF THE DRAWINGS

The details of typical embodiments of the present invention will be described in connection with the accompanying drawings, in which.

BEST MODE OF THE INVENTION

Figure 2:
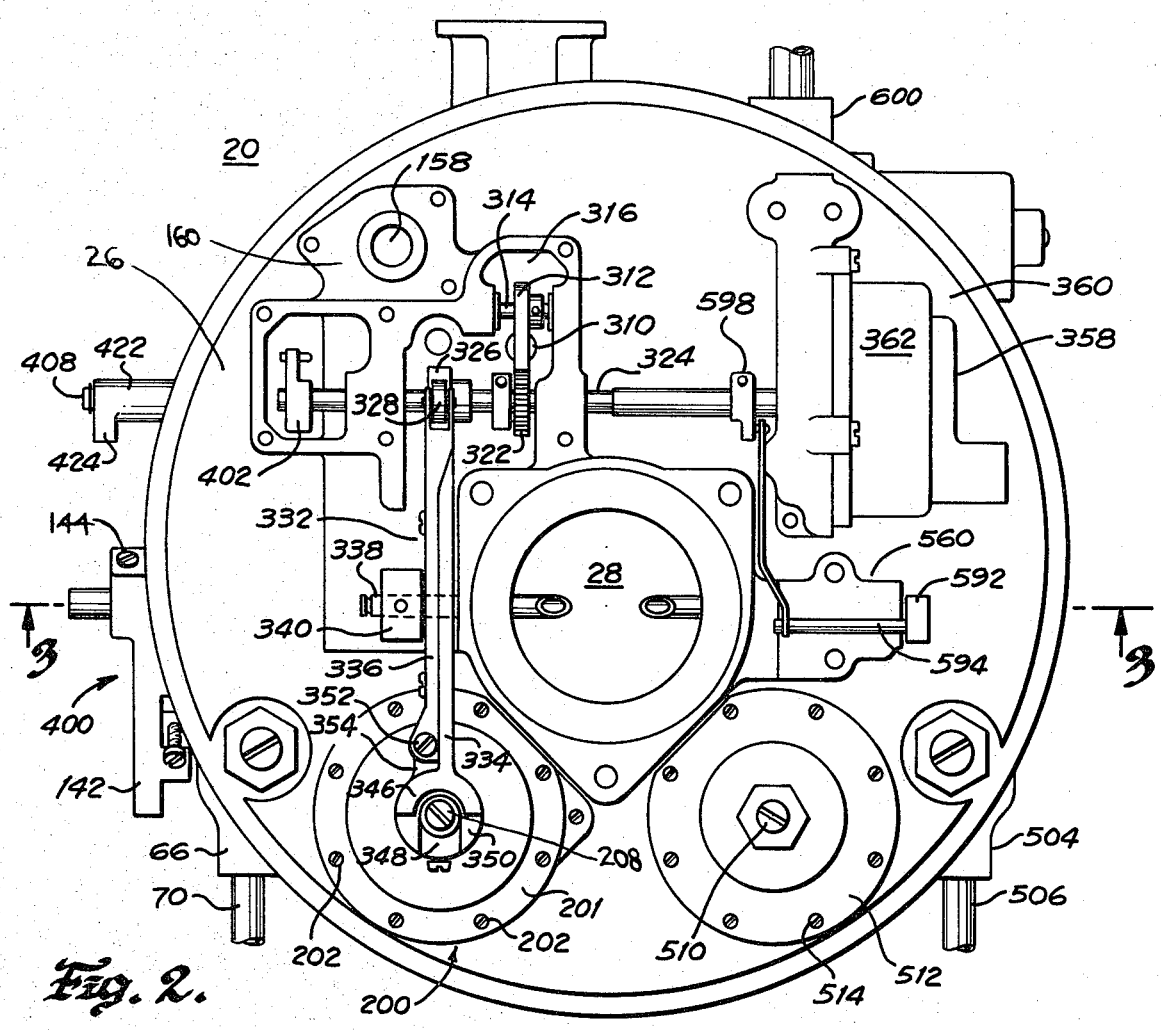
FIG. 2 is a top view of a typical embodiment of a carburetor utilizing the components illustrated in FIG. 1 with the arrow pointing toward the front of the carburetor.
Figure 3:
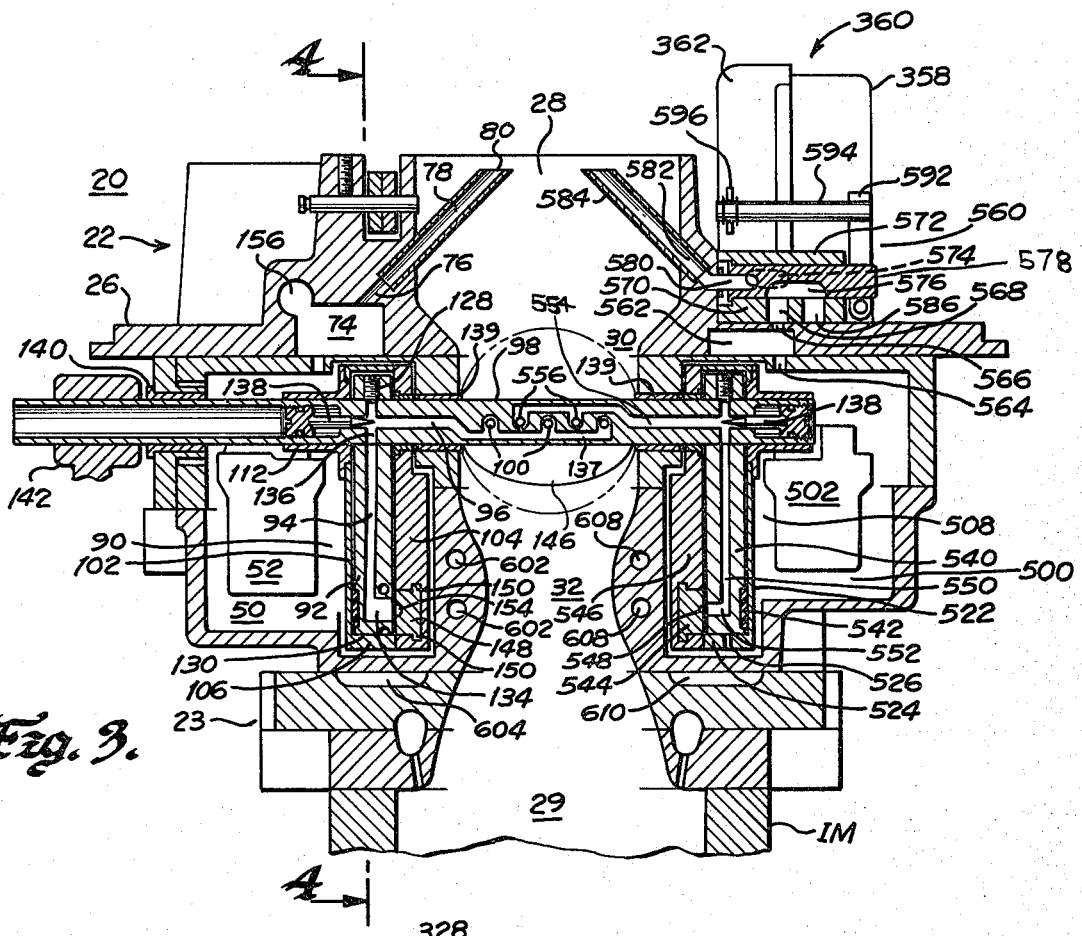
FIG. 3 is a rear elevational cross-sectional view of the carburetor shown in FIGS. 1 and 2 taken substantially along lines 3—3 of FIG. 2.

Referring initially to FIGS. 2-5, a typical embodiment of an improved carburetor 20 constructed according to the best mode of the present invention currently known to applicant is illustrated as including a body 22 formed with a flat lower base 23 securable to an intake manifold IM of an internal combustion engine, not shown, by nuts 24 engaging with the threaded upper ends of manifold studs 25 extending upwardly through openings formed in the base. A stepped flange plate 26 encircles the upper central portion of body, 22 upon which plate an air cleaner, not shown, may be mounted. As best shown in FIG. 3, a passage consisting of sequentially an air horn 28, venturi section 30, and throat 32, extends downwardly through a generally centrally located portion of carburetor body 22 to interconnect in fluid flow communication with the inlet opening 29 of manifold IM. Air horn 28 is preferably circular in cross-section and larger in diameter than venturi section 30. Additionally referring to FIGS. 13 and 13A-13C, extending downwardly from venturi section 30, throat 32 in cross-section transitions into a first eliptical or oblong section 34 extending fore and aft relative to body 22 and then a lower second oblong or eliptical section 36 extending transversely to upper oblong section 34. The cross-sectional areas of throat 32 throughout venturi section 32 and first and second oblong sections 34 and 36 are preferably constant. The turbulation caused by the continuous change in profile of throat 32 below venturi section 30 is designed to improve the mixing of the atomized fuel with the air flowing downwardly through the carburetor.

Figure 9:
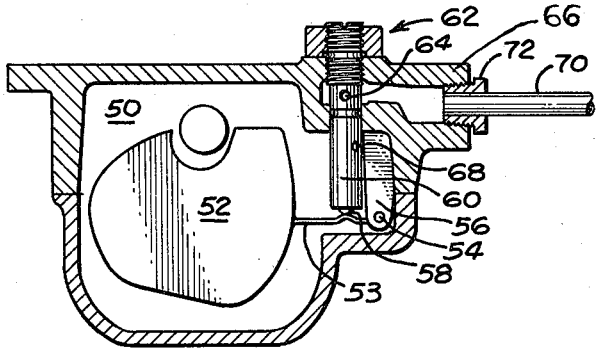
FIG. 9 is a fragmentary cross-sectional view of the carburetor illustrated in FIGS. 1-9 depicting the construction of a typical carburetor reservoir.

Next referring to FIGS. 3 and 9, carburetor 20 includes a fuel reservoir 50 disposed laterally to the left side of throat 32 as viewed in FIG. 3 at an elevation below air horn 28 and above body base 23. A float 52 is fixed to one end of a float arm 53 to pivot up and down about a hinge pin 54 in response to the fuel level within reservoir 50. Hinge pin 54 is supported for rotation about its longitudinal axis by a pin hangar 56 disposed within reservoir 50. Float arm 53 includes an upwardly extending, curved central portion which pushes upwardly against a needle 58 which fits against a seat formed in the cylindrical, hollow housing 60 of a needle valve 62 when float 52 rises upwardly in response to the increased level of fuel within reservoir 50. Needle valve housing 60 includes at least one cross hole 64 in fuel flow communication with reservoir inlet 66 to permit fuel supplied to the inlet to pass into the hollow interior of housing 60 and then downwardly therethrough to exit into reservoir 50 through lower cross holes 68 in the housing. Fuel from a fuel pump, not shown, is supplied through inlet line 70 which is attached to the threaded end portion of inlet 66 by use of a conventional fitting or nipple 72. The upper end portion of needle valve housing 60 is threaded to engage within a correspondingly threaded opening formed in carburetor body 22 to thereby enable the housing to be vertically adjusted in response to the desired maximum elevation of fuel within reservoir 50.

Still referring to FIG. 3, the upper portion of fuel reservoir 50 is vented to a vent cavity 74 which in turn is in air flow communication with an air inlet passageway 76 extending diagonally upwardly into air horn 28. A vent tube 78, pressed within vent cavity 74, extends diagonally upwardly through air horn 28 to terminate at a beveled upper end portion 80 defining an upwardly facing opening for tube 78. Tube 78 vents fuel reservoir 50 into air horn 28 to thereby balance the air pressure therebetween so that increased resistance to air flow through air horn 28, for instance caused by a clogged air cleaner, will not result in too rich of an air-fuel mixture due to the increased vacuum developed in the air horn.

Figure 4:
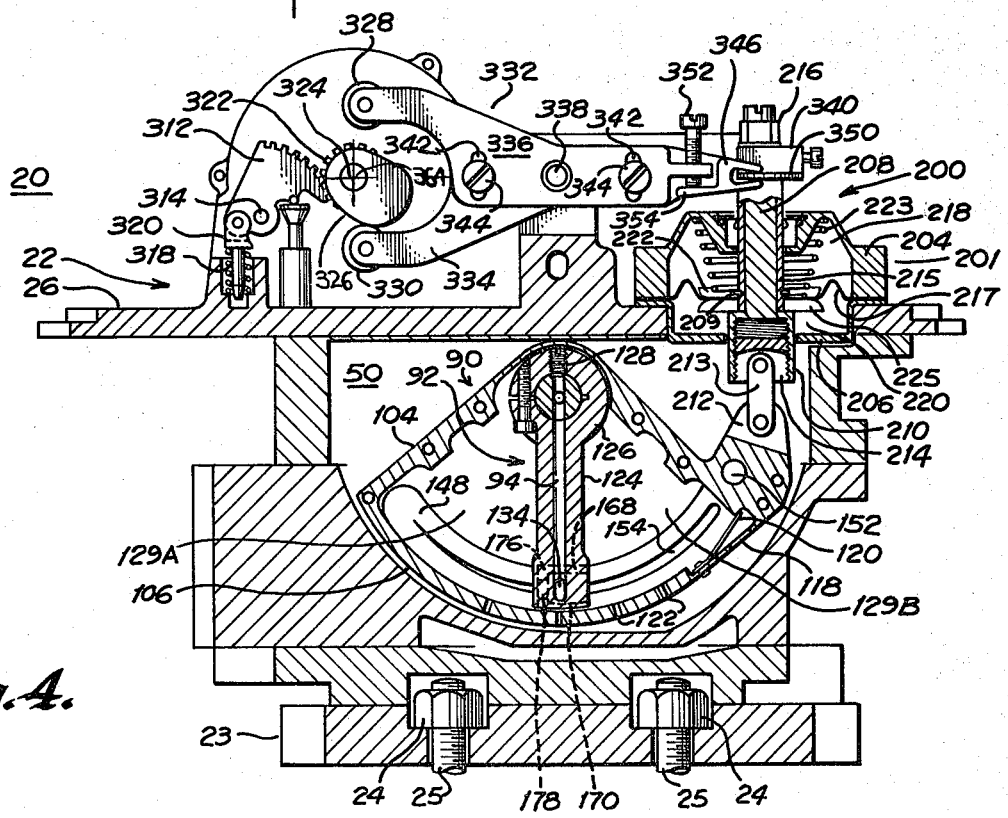
FIG. 4 is a side elevational cross-sectional view of the carburetor shown in FIGS. 1—3 taken substantially along lines 4—4 of FIG. 3 specifically illustrating the orientation of the fuel flow regulating system cam lobe when the engine is warm.

Next turning to FIGS. 3 and 4, fuel within reservoir 50 is supplied to venturi section 30 through a unique delivery system wherein fuel from the reservoir first flows into a substantially enclosed metering chamber 90, up through a passageway 94 formed in an elongate metering arm 92, then horizontally through a fuel passageway 96 formed in spray bar 98 and finally out through outlet openings 100 formed in the spray bar. Metering chamber 90 is substantially hollow in construction and shaped generally in the form of a segment of a circle which is disposed in upright orientation. The metering chamber includes a pair of spaced apart sidewalls 102 and 104, each having substantially flat inside surfaces disposed parallel to each other. A curved bottom wall 106 closes off the bottom of chamber 90 while top walls 108 close off the two sloped top surfaces of the chamber. The curvature of bottom wall 106 generally corresponds to the arcuate curvature of the bottom of fuel chamber 50, FIG. 4. Although not imperative, side wall 102, bottom wall 106 and top walls 108 are formed as a single integral unit which is assembled with sidewall 104 by screws 110 shown best in FIG. 1 extending through clearance holes formed in sidewalls 102 to engage within threaded holes formed in sidewall 104. Aligned openings are formed in sidewall 104 and in an elongate hub member 112 projecting outwardly from sidewall 102 to receive circular spray bar 98 therethrough to thereby suspend the metering chamber from the spray bar. As illustrated best in FIG. 9, fuel float 52 is relieved at its upper edge portion to provide clearance for spray bar 98 and hub member 112.

Figure 1:
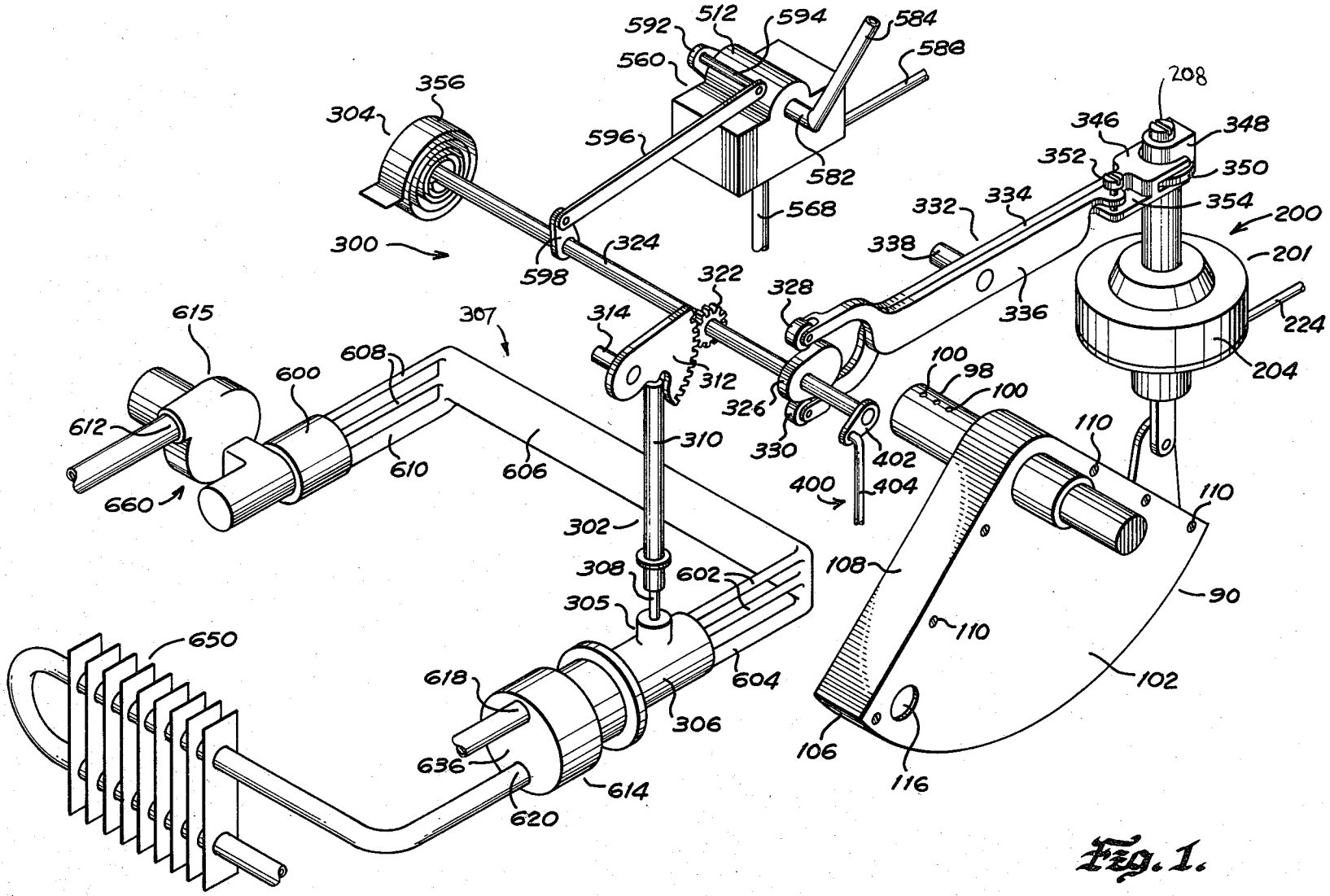
FIG. 1 is a schematic view of a fuel flow regulating system, carburetor heating system and coolant recirculation system of one typical embodiment of a carburetor constructed according to the present invention.

As shown in FIG. 1, a fuel inlet opening 116 is formed in metering chamber sidewall 102 at a location near the intersection of bottom wall 106 and top wall 108 to allow passage of fuel between reservoir 50 and the metering chamber. Referring to FIG. 4, a second fuel inlet opening 118 is formed in bottom wall 106 at the end portion thereof opposite from opening 116. A normally open spring valve 120 is mounted on bottom wall 106 to close off opening 118 when the fuel pressure within chamber 90 reaches a sufficient level above the pressure of the fuel within reservoir 50. A plurality of relatively small diameter pressure relief ports 122 are formed along the length of bottom wall 106 to permit fuel at a limited, controlled rate to pass between chamber 90 and reservoir 50.

The fuel delivery system, as best shown in FIGS. 3, 4, 11, 11A and 11B, also includes an elongate metering arm 92 disposed within the interior of metering chamber 90. Metering arm 92 includes an elongate, substantially straight shank portion 124 which depends downwardly from an enlarged, circular head portion 126 having a central opening formed therein for snugly engaging over spray bar 98. Metering arm 92 is securely attached to the spray bar by a set screw 128 which extends downwardly through a tapped hole formed in head portion 126 in alignment with the diametrical center of the head portion to seat within a tapered cross hole formed within the spray bar. The sides of metering arm shank portion 124 are substantially flat and parallel and are spaced apart a distance slightly less than the distance separating the inside surfaces of metering chamber walls 102 and 104 to closely fit within the metering chamber and thereby separate the metering chamber into a forward section 129A and a rearward section 129B divided by the metering arm, FIG. 4. The volume of each section changes as the metering arm swings within chamber 90. The lower surface 130 of metering arm 92 is disposed closely adjacent to metering chamber bottom wall 106 and is curved along an arc corresponding to the curvature of the bottom wall. As most clearly shown in FIG. 11, the lower end portion of metering arm shank 124 at the side adjacent metering chamber sidewall 102 is relieved to receive a U-shaped bearing member 132. A pair of compression springs 133, housed within slots 135 formed with the relieved section of the metering arm, urge bearing member 132 outwardly to press against sidewall 102 which in turn urges metering arm 92 to slide against the inside surface of wall 104 as the arm pivots.

A fuel passageway 94 extends upwardly through metering arm 92 to deliver fuel from metering chamber 90 to spray bar 98. Passageway 94 includes a horizontally disposed, vertically oblong inlet opening 134 formed in the sidewall of metering arm 92 facing chamber wall 104. The outlet or upper end portion of fuel passageway 94 is aligned with a cross hole 136 drilled in spray bar 98 to thereby interconnect passageway 94 with a longitudinal passageway 96 formed in the spray bar. As best shown in FIG. 3, as passageway 96 extends away from arm 92 toward venturi section 30, it is initially aligned with the center of the spray bar, but then shifts downwardly to the lower portion of the spray bar at 137. A plurality of horizontal outlet openings 100 in communication with passageway portion 136 extend transversely through the spray bar to discharge fuel from the spray bar into venturi section 30. Needle valves 138 are threadably engaged within threaded bores formed within the end portions of spray bar 98 outwardly of passageway 96 to extend into the intersection of cross hole 136 and passageway 96 to control the maximum flow rate of fuel passing up through metering arms 92 and into spray bar 98.

Spray bar 98 is mounted within carburetor body 22 to extend diametrically across a vertical central portion of air horn venturi section 30. Sleeve bearings 139 disposed in carburetor body 22 adjacent the venturi section and a flanged bearing 140 extending inwardly through the outer wall of fuel reservoir 50 permit antifrictional rotation of spray bar 98 about its longitudinal axis. The end portion of the spray bar, extending outwardly beyond fuel reservoir 50, supports an elongate, generally downwardly depending throttle arm 142 clamped to the spray bar by a pair of screws 144, FIGS. 2, 5 and 6. An opening 143 is provided in the lower end of throttle arm 142 for attachment with appropriate throttle linkage for rotation of the spray bar, for instance through the use of a conventional throttle pedal. A generally circular throttle plate 146 is securely mounted on the portion of spray bar 98 extending through venturi section 30 to thereby open and close the venturi section upon rotation of the spray bar.

Next referring to FIGS. 3 and 4, the fuel delivery system also includes a substantially flat fuel metering insert 148 formed generally in the shape of a circle segment for engagement within a correspondingly shaped cavity extending along the lower inside edge portion of fuel chamber wall 104. A pair of flanges 150 extend outwardly from each side of the base portion of insert 148 to engage within correspondingly shaped grooves formed in the metering chamber cavity. Insert 148 is held stationary within wall 104 by a lock pin 152 extending through aligned clearance bores provided in insert 148 and fuel chamber wall 108. A blind, longitudinally extending hole is formed in the side of pin 152 facing wall 102 to retain therein a compression spring, not shown, tending to urge the pin outwardly away from wall 102. Pin 152 is held captive within wall 108 by an overlapping portion of fuel chamber wall 104.

Referring specifically to FIG. 4, a groove 154 of constantly varying width is formed along the length of metering insert 148 to face metering arm 92. The longitudinal center of groove 154 extends along a circle having its center coincident with the rotational center of spray bar 98. Also, the longitudinal center line of groove 154 is substantially aligned with the center of inlet opening 134 of metering arm passageway 94 so that the opening faces and slides along groove 154 as the metering arm pivots with spray bar 98. As the metering arm pivots within metering chamber 90, the width of groove 154 addressing passageway inlet 134 continually varies. Thus, since fuel must pass through groove 154 to reach inlet 134, the angular position of metering arm 92 relative to metering chamber 90 governs the rate at which fuel can pass through metering arm passageway 94 and into spray bar passageway 96. When spray bar 98 is rotated to open throttle plate 146, metering arm 92 is pivoted toward the wider end portion of groove 154 so that more fuel is discharged into venturi section 30. Conversely, when throttle plate 146 is closed, the metering arm swings toward the narrower end portion of groove 154 to thereby reduce the flow rate of fuel discharged from the spray bar.

An accelerator pump pressure block circuit 166 is formed in the lower end portion of metering arm 92 to provide additional fuel to passageway 94 as arm 92 is rapidly swung through chamber 90, for instance, when throttle plate 146 is rapidly opened during hard acceleration. As best shown in FIGS. 4, 11, 11A and 11B, circuit 166 includes an upper inlet passageway 168 and a lower inlet groove 170, both extending transversely of the length of arm 92 and having openings 172 and 174, respectively, in the side of arm 92 facing the wider end portion of metering insert groove 154. The opposite ends of inlet passageway 168 and inlet groove 170 are interconnected by a vertically extending passageway 176 which intersects with an outlet passageway 178 extending horizontally transversely to the inlet passageway groove and parallel to inlet opening 134. Outlet passageway 178 is disposed on the side of inlet opening 134 facing the narrower end portion of metering insert groove 154.

In operation, as arm 92 swings through metering chamber 90 toward the wider end portion of metering insert groove 154, fuel within the metering chamber rearward section 129B flows through inlet passageway 168 and inlet groove 170 and out outlet passageway 178 to thereby supply fuel to inlet opening 134 at increased pressure thus increasing the flow rate of fuel up through the metering arm. Moreover, the volume of this elevated pressure fuel supply to inlet opening 134 is proportional to the rate at which arm 92 swings through metering chamber 90 which in turn generally corresponds to the rate at which increased power is needed, for instance, during acceleration. Moreover, it is to be appreciated that through pressure block circuit 166, increased fuel is supplied to the engine as needed without requiring any moving parts as opposed to the construction of acceleration circuits of conventional carburetors.

Figure 5:
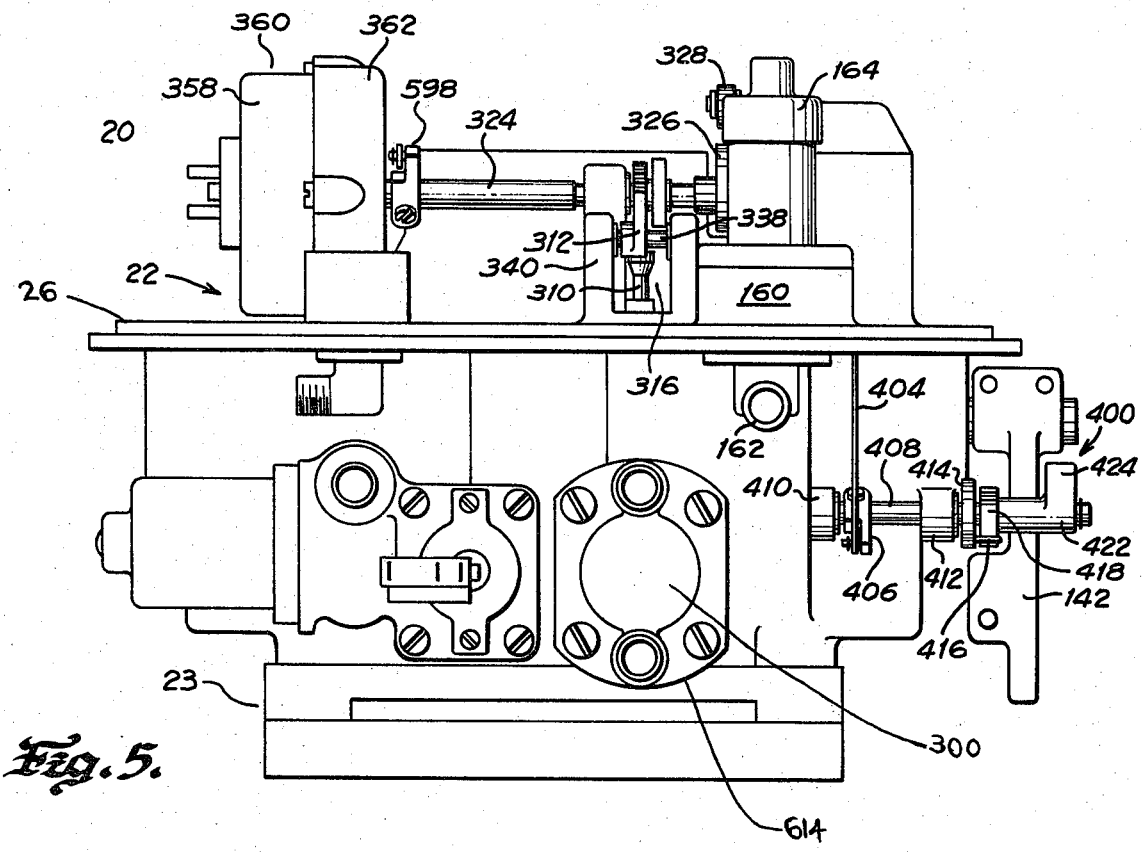
FIG. 5 is a front elevational view of the carburetor illustrated in FIGS. 1–4.

As best shown in FIGS. 3 and 5, an elongate passageway 156 extends forwardly along carburetor body 22 from fuel reservoir vent cavity 74 to transversely intersect a vertical bore 158 formed in mounting pad 160. An outlet fitting 162, FIG. 5, connected in fluid flow communication with bore 158, is secured to the underside of mounting flange 26. A flat disk-shaped valve actuated by an electrically operated solenoid 164 is adapted to open or close bore 158 to permit fluid flow communication between passageway 156 and vertical bore 158 when the engine is turned off while preventing such communication when the engine is running. As a consequence, fuel vapors emanating from reservoir 50 produced by heat from the engine after it is turned off passes through passageway 156, down bore 158 and out fitting 162 to a charcoal canister or other type of device, not shown, wherein the vapors are either absorbed or condensed into liquid rather than being emitted into the atmosphere. The fuel vapors, being heavier than air, do not tend to escape through vent tube 78.

Next referring to FIGS. 1, 2 and 4, the improved carburetor of the present invention includes a vacuum actuated fuel flow regulator assembly 200 for metering the rate of fuel flowing through metering arm 92 as a function of inlet manifold vacuum, which in turn is related to engine speed and load. With a reduction in manifold vacuum, such as during hard acceleration, a richer air-fuel mixture is required to obtain maximum power. The assembly 200 includes a vacuum housing 201 mounted on top of carburetor body 22 over the rear portion of fuel reservoir 50 by a plurality of screws 202. Vacuum housing 201 includes an upwardly dished upper section 204 and a downwardly dished lower section 206 which pilots downwardly into a closely fitting circular opening formed in flange plate 26. Aligned openings are centrally formed in the upper and lower housing members to closely and slidably receive an elongate sleeve 215 which engages over the upper shank portion of a stepped diameter actuating rod 208 having a threaded upper end portion for engaging with a nut 216 serving to anti-rotationally secure rod 208 to sleeve 215. Rod 208 also includes an enlarged hollow lower end portion 210 connected to an ear member 212 extending upwardly from the rear portion of metering chamber 90 by a link 213 pivotally pinned at opposite ends to the ear member and to an insert 214 threadably engaged with the interior of actuating rod lower end portion 210. The upper end of rod 208 extends upwardly above housing upper section 204. Sleeve 215 is held against rotation relative to housing upper section 204. The relative engagement between rod 208 and insert 214, and thus the nominal angular orientation of chamber 90, is adjusted by rotating the rod within sleeve 214 after first loosening nut 216 which is engaged with the threaded upper end of the rod to bear downwardly against the upper end of sleeve 215.

A flexible diaphragm member 217 divides the interior of housing 200 into an upper chamber 218 and a lower chamber 220. The central portion of diaphragm 217 is sandwiched between a pair of circular plates 222 and 225 which engage over sleeve 215. Plate 222 and diaphragm 217 are fixed to the sleeve by a snap ring 209. Plate 225, threaded to the lower end of sleeve 214, can be adjusted to bear upwardly against diaphragm 217. A tapered compression spring, engaged over sleeve 215, is disposed within upper chamber 218 to press downwardly against circular plate 222 and upwardly against housing upper member 204 to thereby normally bias rod 208 in the downwardly direction. Vacuum housing upper member 204 includes an inlet opening 224 connected in fluid flow communication with the intake manifold by a vacuum line, not shown. Thus, when the engine is running at normal cruise conditions, the high vacuum level within the intake manifold, e.g. above eight inches of mercury, overpowers the force of spring 223 thereby causing actuating rod 208 to lift upwardly and metering chamber 90 to pivot in a counter-clockwise direction as shown in FIG. 4, so that a narrower portion of metering insert groove 154 is located adjacent metering arm inlet 134 so that less fuel is supplied to venturi section 30. Conversely, when the vacuum level in the intake manifold drops, such as during acceleration or engine lugging, the force of spring 223 overcomes the effect of the vacuum level within upper chamber 218 to thereby push actuating rod 208 downwardly and thereby pivot metering chamber 90 in a clockwise direction as shown in FIG. 4. As a consequence, a wider portion of metering groove 154 is exposed to metering arm inlet opening 134 thereby allowing proportionally more fuel to pass through the metering arm for discharge into venturi section 30 so that an enriched air-fuel mixture reaches the engine.

Improved carburetor 20 constructed according to the present invention also includes a thermally activated fuel flow regulating system 300 which regulates fuel flow through metering arm 92 based on the temperature of the engine thereby compensating for the fact that at lower engine temperatures, fuels, such as gasoline, vaporize very poorly and thus a richer air-fuel mixture is required for satisfactory engine operation. In basic form, as shown in FIGS. 1, 2 and 4, thermal fuel flow regulating system 300 includes an engine coolant temperature responsive actuating assembly 302 and a manifold temperature responsive actuating assembly 304, both adapted to either raise or lower vacuum assembly actuating rod 208 or limit the movement of the actuating rod based on the temperature of the engine coolant and intake manifold. Actuating assembly 302 includes a mixture control thermostat 305, FIG. 7, which is disposed within the inlet portion 306 of an engine coolant passageway system 307 extending through carburetor body 22, as discussed more fully below. Thermostat 305 includes a plunger 308 which raises upwardly with increased coolant temperature passing through water jacket inlet 306, and correspondingly lowers as the temperature of the coolant reduces. Plunger 308 reaches its full upward travel when the coolant within inlet 306 reaches approximately 140°.

Actuating assembly 302 also includes a push rod 310 guided for vertical movement in response to the movement of plunger 308. The lower end of push rod 310 rests against the upper end of plunger 308 while the upper end of rod 310 extends above carburetor flange plate 26 to push against a segmented gear 312 thereby pivoting the segmented gear about a pivot pin 314 which supports the gear between spaced apart sidewalls of cavity 316 which houses the segmented gear and upper portion of the push rod, FIGS. 2 and 5. As best shown in FIG. 4, a compression spring 318 is seated within the shoulder of a stepped pivot stud 320, which is pivotally attached to the end portion of segmented gear 312 opposite push rod 310, to thereby normally bias the segmented gear to rotate in a clockwise direction thereby pressing downwardly against the upper end of the push rod.

Figure 14:
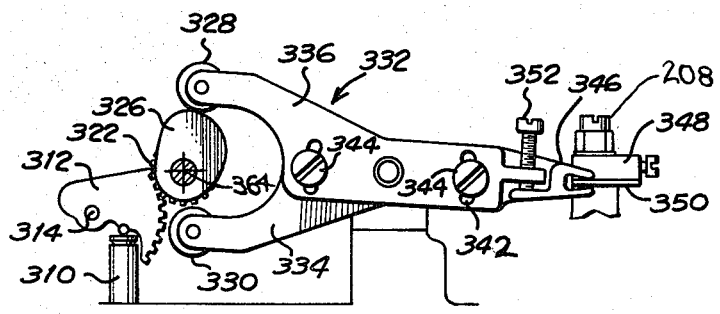
FIG. 14 is a fragmentary side elevational view of the carburetor shown in FIGS. 1-13C, specifically illustrating the orientation of the cam lobe when the engine is in cold condition.

Additionally referring to FIG. 14, segmented gear 312 is meshed with a circular spur gear 322 fixed to an intermediate portion of an elongate, horizontally disposed control rod 324 journaled within openings formed in carburetor body 22 to extend transversely across carburetor 20 at an elevation above flange 26. A generally elliptically-shaped cam lobe 326 is also fixed to control rod 324 to rotate therewith. Cam lobe 326 is flanked above and below by rollers 328 and 330 rotatably mounted on the end portions of a pivoting scissors link arm assembly 332. Scissors arm assembly 332 includes a longer arm 334 corresponding to lower roller 330 and a shorter arm 336 corresponding to upper roller 328. Longer arm 334 has a downwardly curved end portion which extends below cam lobe 326 while shorter arm 336 has an upwardly curved end portion extending above the cam lobe. Arms 332 and 334 have substantially flat, elongate intermediate portions disposed vertically edgewise to define aligned through holes for engaging over a close fitting pivot pin 338 which spans between an upstanding lug portion 340 and air horn 28 of carburetor body 22, FIG. 2. As best illustrated in FIGS. 4 and 14, a pair of curved slots 342 are formed in shorter arm 336 on each side of pivot pin 338, with the center of the curvature of the slots corresponding to the center of the pivot pin. Longer arm 334 includes threaded through holes for receiving the threaded end portion of lock screws 344 which limit the maximum angle which the arms 334 and 336 can pivot relative to each other.

Still referring to FIGS. 1, 2 and 4, a yoke member 346 is formed at the end portion of longer arm 334 opposite roller 330 to engage with the upper end of diaphragm assembly sleeve enlarged upper end portion 348. Yoke member 346 includes a central U-shaped vertical opening for receiving and holding captive sleeve enlarged portion 348. A horizontally extending, tapered slot extends vertically centrally through yoke member 346 to receive blades 350 which extend outwardly from each side of sleeve enlarged portion 348 to thereby constrain the yoke end portion of arm 334 to ride up and down with diaphragm 217 thus accommodating the angular movement of arm 334 relative to the vertical movement of sleeve 215 as the arm pivots about pin 338. An adjustment screw 352 extends downwardly to a threaded vertical opening formed in the end portion of shorter arm 336 to bear downwardly against a landing 354 provided at the intersection of arm 334 and its yoke 346.

Manifold temperature responsive actuating assembly 304 includes a bimetallic spring or coil 356 having its inward end portion secured to the end of control rod 324 distal from cam lobe 326 and its outside end portion fixed to the cover 358 of thermostat housing 360, FIGS. 1, 2 and 3. Thermostat housing 360 also includes a stationary base portion 362 mounted on carburetor flange plate 26. Thermostat housing 360 is adapted to receive air from an exhaust gas heated pocket located in the intake manifold to thereby cause bimetallic coil 356 to expand as the intake manifold warms. Air from housing 360 is drawn through a passageway, not shown, formed in the carburetor body 20 to exit through an opening formed in base 22 and flow into intake manifold IM. Thermostat housing cover 358 may be rotated relative to base portion 362 to coil up or unwind coil 356 to thereby adjust the initial angular position of control rod 324 when the engine is cold.

In operation, when the engine is cold, push rod 310 of actuating assembly 302 is in full downwardly retracted position and bimetallic coil 356 of second actuating assembly 304 is in tightly coiled, retracted position. Correspondingly, cam lobe 326 is angularly orientated in full counter-clockwise position as viewed in FIG. 14, so that a minimum distance separates the rotational center of the cam and lower roller 330 thereby allowing pivot arm 334 to pivot in the clockwise direction under the action of spring 223 to force actuating rod 208 downwardly to pivot fuel metering chamber 90 in the clockwise direction thereby enriching the air-fuel mixture reaching venturi 30. Also, when the engine is cold, a maximum distance separates the rotational center of the cam and upper roller 328 so that even if the manifold vacuum level is high enough to overcome the force of spring 223, arms 334 and 336 are only allowed to rotate counter-clockwise through a limited angle thus restricting the extend to which the air fuel ratio may be leaned. As the engine warms, bimetallic spring 356 which is designed to react faster to engine manifold temperature than the speed at which actuating assembly 302 reacts to engine coolant temperature, initiates rotation of rod 324 in the clockwise direction, FIG. 1, and then as the coolant in passageway inlet 306 begins to warm, push rod 310 is forced upwardly to eventually override bimetallic coil 356 and further rotate cam lobe 326 so the minimum distance separating the rotational center of the cam and lower roller 360 increases while the minimum distance separating the cam rotational center and upper roller 328 decreases thus nominally positioning metering chamber 90 in leaner air-fuel ratio position even when the intake manifold IM vacuum level is low, and also further leaning the air-fuel ratio when the vacuum level raises, for instance during cruise conditions.

Figure 6:
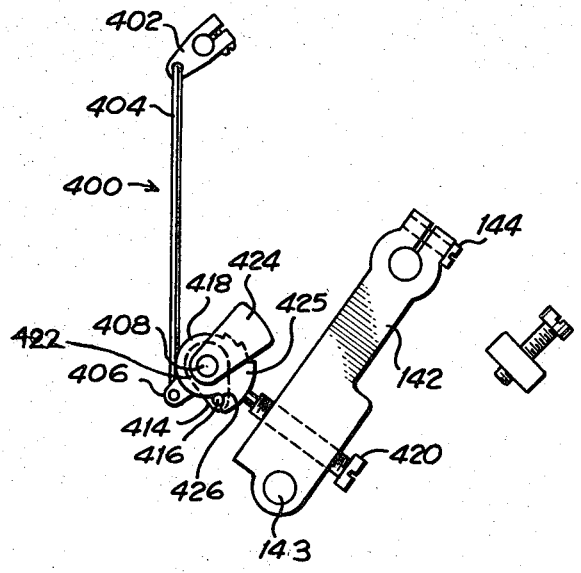
FIG. 6 is a side elevational view of the fast idle system illustrated in FIG. 5 with the idle cam orientated at fast idle.

Next referring to FIGS. 2, 5 and 6, while the engine is cold, it is desirable to idle the engine at a faster speed than normal to prevent it from dying. This is accomplished by a fast idle system 400 which includes a control lever 402 fixed to and extending transversely from the end portion of control rod 324 opposite bimetallic spring 356. The transverse upper end portion of an elongate rod 404 extends through an opening formed in the end of control lever 402 opposite control rod 324. Rod 404 includes an elongate, straight, intermediate portion extending downwardly to terminate at a transverse lower end portion which engages with one end of a lower lever 406 clamped to and extending laterally from a rotatable fast idle camshaft 408. Camshaft 408 is rotatably journaled within spaced apart lugs 410 and 412 formed as part of carburetor body 22, FIG. 5. A drive disc 414 is fixedly secured to the portion of camshaft 408 cantilevered outwardly from outer lug 412. Drive pin 416 extends outwardly from drive disk 414 to overlap a fast idle cam 418 which is pivotally mounted on shaft 408. As best shown in FIG. 6, cam 418 has a series of steps at varying radial distances from the center of shaft 408 for bearing against the end portion of an elongate adjustment screw 420 transversely, threadably engaged within the end portion of throttle arm 142 disposed opposite spray bar 98. A counterweight 422 is fixedly attached to and extends transversely outwardly from cam 418 to also pivot on camshaft 408. The counterweight includes a transverse arm portion 424 which tends to rotate cam 418 in the clockwise direction as shown in FIG. 6. However, when the engine is cold, as shown in FIG. 6, the angular orientation of control rod 324 pushes rod 404 downwardly to thereby cause drive pin 416 to push against a seat 426 formed in cam 418 to thereby rotate the cam in a counter-clockwise direction so that the end of adjusting screw 420 rides against the largest diameter portion 425 of the cam. This causes throttle plate 146 to be rotated to a partially open position thereby causing the engine to idle at a relatively fast rate. As the engine warms, control bar 324 is caused to rotate in the clockwise direction, as shown in FIG. 4, thereby also rotating drive pin 416 in the clockwise direction away from seat 426. When this occurs, counterweight 422 causes cam 418 to rotate in the clockwise direction so that adjusting screw 420 bears against progressively reduced diameter steps or landings of the cam thereby further closing throttle plate 146 to reduce the engine idle speed. It will be appreciated that by the above construction of metering chamber 90, metering arm 92, vacuum assembly 200 and fuel flow regulating system 300, fuel is metered through a single circuit during all engine speeds, temperatures and load conditions thus eliminating the structural and operational complications of conventional carburetors. Also, the above described structure eliminates the need for a separate choke system to enable the engine to start and operate during cold conditions.

Referring to FIG. 3, carburetor 20 of the present invention also includes a second liquid reservoir 500 disposed on the opposite side of body 22 from fuel reservoir 50. Also, a second delivery system is utilized to deliver the liquid from reservoir 500 to venturi 30 through spray bar 98. Although the second liquid may be composed of a second fuel, such as alcohol, or a mixture of a second fuel and water, preferably it consists of water. The water is vaporized by the heat of combustion generated in the engine cylinders to not only increase the combustion pressure within the cylinder, but also to increase the octane rating of the first fuel. Accordingly, the second reservoir 500 and the second liquid delivery system will be described as utilizing water. Also, since the construction and operation of the liquid reservoir 500 and fuel reservoir 50, and the liquid delivery system and the fuel delivery system are very similar, only their differences will be described with particularity.

Water reservoir 500 is constructed similarly to fuel reservoir 50 with the exception that it is located on the opposite side of venturi 30. Also, a float system similar to that utilized in conjunction to fuel reservoir 50 is utilized with water reservoir 500 including a float 502 which raises and lowers with the water level within reservoir 500 to open and close a water inlet port 504 connected in communication with an external water supply source by line 506, FIG. 2.

Figure 10:
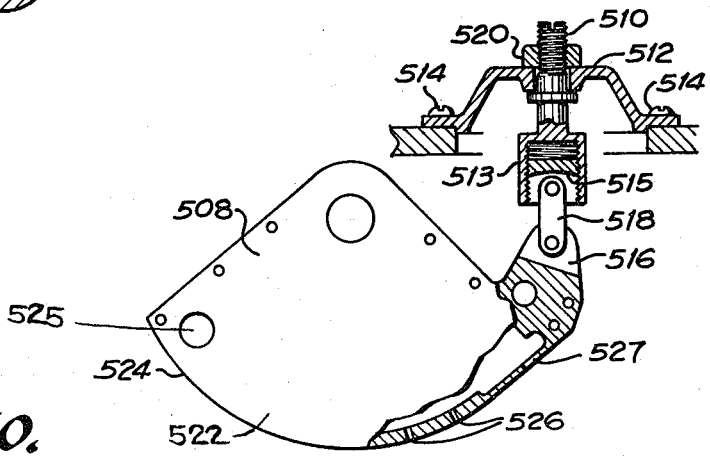
FIG. 10 is a fragmentary cross-sectional view of the carburetor shown in FIGS. 1-9, specifically illustrating the construction of a water metering chamber adjustment rod.
Figure 11:
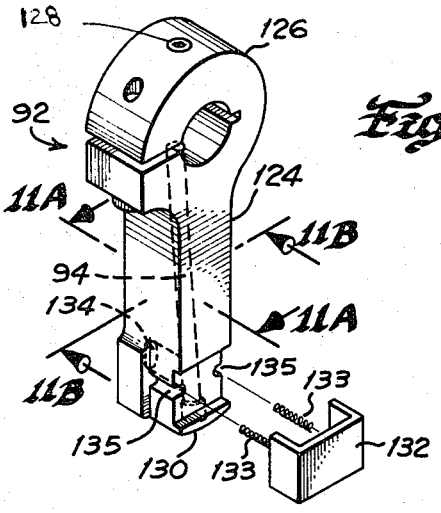
FIG. 11 is an enlarged, fragmentary, isometric view of a typical fuel metering arm utilized in the carburetor depicted in FIGS. 1-10.

Water within reservoir 500 is supplied to venturi 30 through a delivery system which includes a substantially closed metering chamber 508 constructed very similarly to fuel metering chamber 90 described above. As shown in FIGS. 3 and 11, metering chamber 508 is suspended from the end of spray bar 98 opposite chamber 90. However, chamber 508 is not adapted to rotate on spray bar 98 in response to intake manifold vacuum level or engine temperature. Rather, chamber 508 is held in adjusted stationary position by an adjusting rod 510, FIG. 10, extending downwardly through a cover 512 mounted on the upper side of flange plate 26 by screws 514. The lower end of rod 510 is formed in the shape of an enlarged, threaded socket 513 for receiving a threaded plug 515 which is connected to a metering chamber ear member 516 through the intermediacy of a link 518 pinned at opposite ends to the ear and to the lug. The angular orientation of metering chamber 508 is adjusted by varying the engagement of the rod with plug 515. After adjustment, the rod is held against further movement by tightening lock nut 520.

As with fuel metering chamber 90, water enters metering chamber 508 through an inlet opening 525 in sidewall 522. Metering chamber 508 also includes a plurality of bleed ports 526 formed along the length of bottom wall 524. Metering chamber 508 also includes an inlet port 527 which corresponds to inlet port 118 of metering chamber 90; however, no spring valve is used to block fuel exit from port 527 as pumping action is not desired when water or a noncombustible mixture of fuel and water is used.

Figure 12:
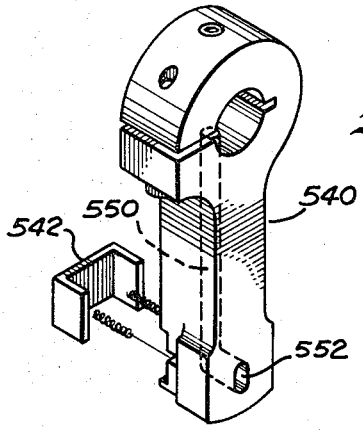
FIG. 12 is an enlarged, fragmentary, isometric view of a water metering arm utilized in the carburetor shown in FIGS. 1-11B.
Figure 13A:
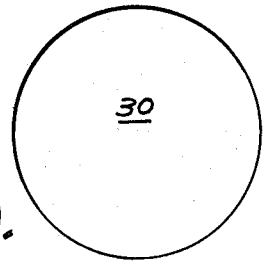
FIGS. 13A, 13B, and 13C are schematic cross-sectional views of portions of the carburetor throat shown in FIG. 13 taken along lines 13A—13A, 13B—13B, and 13C—13C, respectively, thereof.
Figure 13:
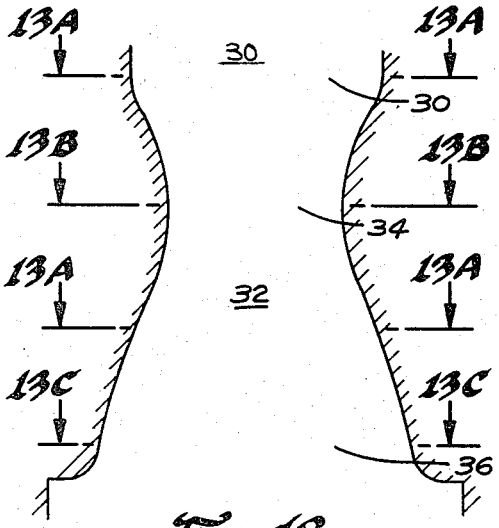
FIG. 13 is a schematic view illustrating the profile of the throat from approximately the elevation of the spray bar down to the intake manifold, as viewed from the rear of the carburetor.
Figure 13B:
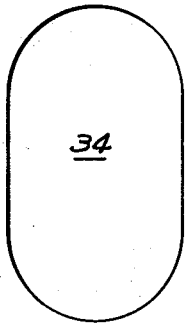
Figure 13C:
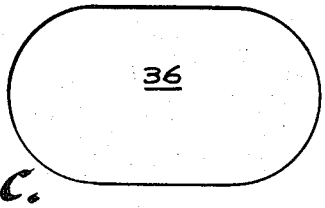

Now referring additionally to FIG. 12, the water delivery system also utilizes a metering arm 540 constructed very similarly to fuel metering arm 92 to pivot within chamber 508 as spray bar 98 rotates about its longitudinal axis. As with metering arm 92 discussed, metering arm 540 also includes a spring loaded, U-shaped rubbing block 542 which presses the opposite side of the arm against a metering insert 544 engaged within an arcuate groove formed along the lower edge portion of chamber wall 546. Metering insert 544 is also formed with a tapered groove 548 which is narrower than groove 154 formed in fuel metering insert 148. As with metering arm 92, metering arm 540 also includes a longitudinal fuel passageway 550 having a transverse inlet 552 at the bottom portion of the arm which is disposed in registry with groove 548 when arm 540 swings within chamber 508. Thus, as with arm 92, the flow rate of water through arm 540 varies with the position of the arm within chamber 508. The upper end of passageway 550 is disposed in water flow communication with a second elongate passageway 554 formed within spray bar 98 to extend from the right end portion of the spray bar, shown in FIG. 3, to terminate in the central portion of the spray bar disposed within venturi 30. The portion of passageway 554 extending along the central portion of spray bar 98 is disposed upwardly relative to the rotational center of the bar to thereby avoid interference with the corresponding portion 137 of fuel passageway 96. A plurality of horizontal outlet openings 556 in communication with passageway portion 554 extend transversely through the spray bar to enable water disposed within the bar to discharge into venturi section 30. Outlet openings 556 are interspaced between fuel outlet openings 100 so that uniform mixing of the water and fuel occur.

Although, as discussed above, there are many similarities between the water delivery system and the fuel delivery system, the means utilized for regulating the flow rate of water through the delivery system is substantially different than that utilized for the fuel. The flow rate of water is not regulated in response to manifold vacuum level. Also, water is not discharged from spray bar 98 until the engine has reached a preselected temperature, ideally when the engine coolant has warmed to approximately 100°. Once this temperature level is reached, water is discharged into venturi 30 with the flow rate being governed primarily solely by the orientation of the metering arm 540 relative to metering groove 548.

The water regulating system in basic form utilizes a thermally activated water induction shutoff valve 560 to alternatively vent water reservoir 500 to either a relatively high pressure location adjacent the inlet of air horn 28 or a relatively low pressure location just beneath throttle plate 146 when it is in closed position. As illustrated in FIG. 3, the upper portion of water reservoir 500 is interconnected in air flow communication with an overhead vent chamber 562 by a pair of spaced apart orifices 564, one of which is shown. A single orifice 566 extends upwardly from vent chamber 562 to communicate with an aligned, vertical through opening 568 formed in the base 570 of valve housing 572. Through opening 568 may be alternatively disposed in communication with angularly spaced apart, longitudinally extending grooves 574 and 576 formed in the circumference of elongate, circular spool 578 which pivots within a closely fitting bore extending along the length of housing 572. Spool groove 574 is in communication with longitudinal bore 580 extending centrally along the length of and breaking out the end of spool 578 to intersect with a vent passageway 582 extending diagonally upwardly through the wall of air horn 28 to break through to the interior of the air horn top portion. An elongate vent tube 584 is pressed within passageway 582 to extend upwardly from the passageway and terminate at a location just below the top of air horn 28. The upper end of tube 584 is beveled to form an upwardly directed opening to minimize any restriction imposed on the air as it enters the vent tube.

The other groove 576 formed within spool 578 extends in a direction along the spool opposite to the direction of groove 574 to communicate with a vacuum port 586 formed in housing base 570 which in turn intersects with one end of a vacuum passageway 588 extending from port 586 to terminate at an opening, not shown, formed in venturi 32 at an elevation just below throttle plate 146 when in closed position.

Referring to FIGS. 1 and 3, an arm 592 is fixedly attached to and extends transversely from the end portion of spool 578 opposite vent passageway 582. An elongate pivot pin 594 is cantilevered outwardly from the upper end of arm 592 to extend across the top of valve housing 572. The end portions of an elongate link 596 are pivotally connected to the free end portion of pivot pin 594 and to a relatively shorter lever 598 fixedly to and extending transversely from control rod 324.

In operation, when the engine is cold, the angular orientation of control bar 324, acting through link 596, disposes spool 578 so that water chamber vent port 568 is in communication with vacuum port 586. As a consequence, water chamber 500 is subjected to a vacuum level higher than that existing at spray bar outlet openings 556, thereby preventing water from flowing through metering arm 540 and spray bar water passageway 554. When pivot spool 578 is in this orientation, groove 574 is closed off from port 568. However, as the engine warms and control rod 324 rotates, as discussed above, spool 578 is also rotated about its longitudinal axis. When the engine coolant reaches a temperature of approximately 100° F., spool 578 will have rotated far enough to close groove 576 and position groove 574 in communication with port 568 so that water chamber 500 is vented to the top of carburetor air horn 28. Since the air pressure at this location is higher than the pressure at spray bar openings 556, water is permitted to discharge from the spray bar.

Figure 7:
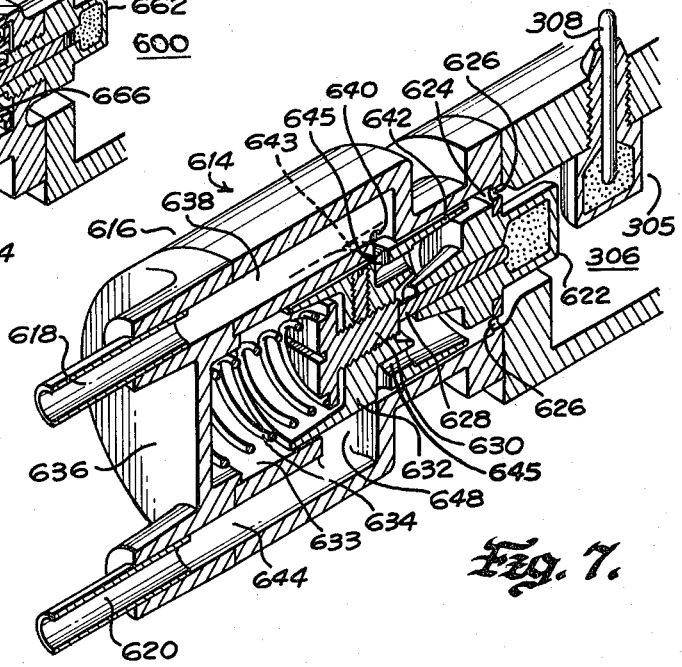
FIG. 7 is an enlarged fragmentary cross-sectional view of the carburetor heating system shown in FIG. 1 specifically illustrating the construction of the coolant mixing valve.

Carburetor 20, as most clearly illustrated in FIGS. 1 and 7, includes an engine coolant circulation system for quickly warming up the carburetor to a preselected maximum temperature to improve the fuel economy and power of the engine without causing vapor lock. The heating system includes a coolant circuit 307 extending through carburetor body 22 with an inlet 306 and an outlet 600 both located in the front portion of the carburetor body, FIGS. 1, 2, 5, 7 and 8. Inlet 306, disposed on the right side of the carburetor, as viewed in FIG. 5, branches into two vertically spaced apart substantially circular passageways 602 which extend rearwardly through body 22 between throat 32 and fuel reservoir 50, and a lower, horizontally wide passageway 604 extending below fuel reservoir 50, FIGS. 1 and 3. Passageways 602 and 604 intersect with a singular upstanding passageway 606 extending across the backside of throat 32. Passageway 606 branches into a pair of vertically spaced apart, substantially circular return passageways 608 which extend forwardly through body 22 between throat 32 and water reservoir 500, and a horizontally broad lower return passageway 610 extending below reservoir 500. Passageways 608 and 610 join together at outlet 600 to enable the engine coolant to collectively exit circuit 307 through outlet port 612 of housing 613 of pump 615.

A thermally controlled mixing valve 614 is bolted to coolant circuit inlet 306 to control the maximum temperature of the coolant flowing through circuit 307, FIGS. 1 and 7. Valve 614 includes a housing 616 having two vertically spaced apart upper and lower inlet ports 618 and 620, with the upper port connected in fluid flow communication with substantially the hottest pressurized engine coolant source available, for instance from a location just prior to the location at which the engine coolant enters the engine cooling system thermostat prior to entry into the radiator. The lower inlet port is connected in fluid flow communication with approximately the coolest pressurized engine coolant source available, for instance, at the pressure side of the engine coolant pump just prior to entry into the engine block. Valve 614 also includes a thermostat 622 mounted on an end wall 624 extending across the outlet end of housing 616. A plurality of holes 626 are formed within the peripheral portion of end wall 624 to allow passage of coolant therethrough. Thermostat 622 includes an elongate plunger 628 which extends horizontally forwardly to push against the adjacent end of an adjusting screw 630 which is threadably engaged within a central portion of an elongate piston 632 adapted to slide longitudinally within housing bore 633. A narrow groove 643 is formed around the outer diameter of piston 632 at a location approximately midway along its length. The groove is formed deep enough to communicate with a series of longitudinal ports 645 formed in piston 632 to direct coolant to the back side of the piston. A compression spring 634 is held captive between the head of adjusting screw 630 and housing end wall 636 to preload piston 632 against plunger 628. The engagement of screw 630 with piston 632 may be adjusted to vary the position of the piston relative to the hot and cool coolant ports to thereby alter the temperature range of the valve.

A hot coolant passageway 638 extends longitudinally along housing 616 from inlet 618 to intersect with cross port 640 which extends through the housing to housing bore 633 to permit hot coolant to pass through groove 643 and ports 645 and further through rear housing wall ports 626 and past thermostat 622 into inlet 306 when the engine is cold or warming up. Housing 616 also includes a cooled coolant passageway 644 extending longitudinally from inlet 620 to deadhead against piston 632 when the engine is cold or warming up. As the engine warms so that temperature of the hot coolant passing through passageway 638 increases, plunger 628 pushes piston 632 forward along housing bore 633 to expose cross port 648 of cool coolant passageway 644 to piston groove 643 and partially close off passageway 638 from groove 643 to thereby mix the cooled coolant from inlet 620 with the diminished flow of hot coolant from inlet 618 to stabilize the resultant temperature of the coolant entering into carburetor circuit inlet 306 to a constant predetermined temperature even through the temperatures of the hot and cooled coolant may be changing. If the temperature of the hot coolant reaches a high enough level, plunger 628 will completely close off cross port 640 so that all of the coolant entering circuit 307 is from cross port 648 of inlet 620.

Although not always necessarily essential, an auxiliary heat exchanger 650, shown in FIG. 1, may be utilized to further cool the coolant entering port 620 to a level below the desired maximum temperature of the coolant flowing through carburetor circuit 307 to thereby insure that the carburetor is not heated above this level. Cooler 650 may be located at any convenient location, such as in front of the engine radiator.

Figure 8:
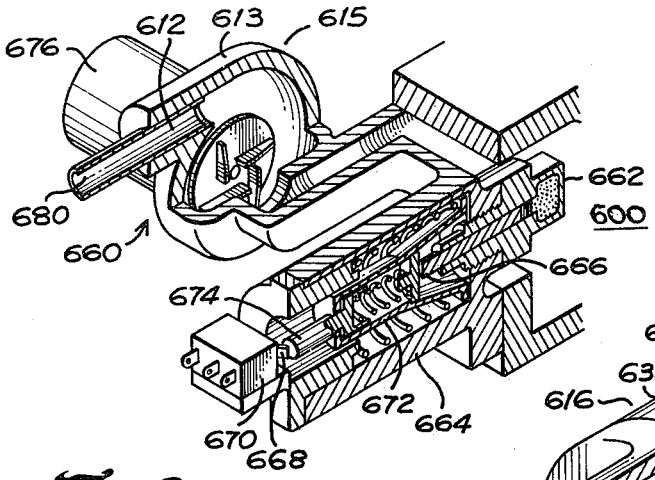
FIG. 8 is an enlarged isometric view, partially in cross section, of the coolant recirculation system illustrated in FIG. 1 specifically showing the construction of the coolant recirculation thermostat controlled switch and pump.

Referring to FIGS. 1 and 8, carburetor 20 of the present invention also includes a coolant recirculation system 660 to prevent boiling of the fuel in reservoir 50 due to heat rising up from the engine and manifolds after engine shutdown. Recirculation system 660 includes a thermostat 662 mounted on a housing 664 and disposed within the interior of carburetor water jacket outlet 600 to sense the temperature of the engine coolant therein. As such coolant increases in temperature, plunger 666 of thermostat 662 pushes against the actuating lever 668 of microswitch 670 through the intermediacy of piston 672 and push rod 674. If, after the engine is shut off, the temperature of the coolant within jacket 307 increases to a preselected level above the normal temperature of a coolant when the engine is running, electrical switch 670 will be switched thereby energizing a motor 676 coupled to pump 615 to thereby draw coolant out of outlet 600 and pump it through line 680 to the suction side of the engine coolant pump, not shown, for recirculation. During this recirculation process, valve 614 modulates the temperature of the coolant entering carburetor coolant circuit 307 to a level below that which activates switch 670 so that eventually the carburetor will be cooled down to a level causing motor 676 to shut off. This cycle will repeat until the engine and manifold temperatures drop to a low enough level that carburetor overheating ceases.

The operation of carburetor 20 will now be described beginning from cold start, through warm up and full operating temperature operation and then engine shutdown and restart. When the engine is started under cold conditions, i.e. below 50° F., push rod 310 of engine coolant temperature responsive actuating assembly 302 is in full retracted position and bimetallic spring 356 of manifold temperature responsive actuating assembly 304 is in fully coiled position thus disposing cam lobe 326 in full counter-clockwise position as shown in FIG. 14. In this orientation cam lobe 326 is positioned so the maximum radius portion of the lobe is directed toward upper roller 328 to push upwardly on upper roller 328 mounted on the adjacent end of shorter rocker arm 336 which in turn forces vacuum assembly actuating rod 208 downwardly so that metering chamber 90 is rotated in a clockwise direction, thus holding metering chamber 90 in its richest operating position. Correspondingly, the minimum radius portion of cam lobe 326 is directed toward lower arm roller 330 thus enabling vacuum spring 223 to force rod 208 downwardly so that chamber 90 is rotated into relatively rich air-fuel ratio positions. Once the engine is started, even though manifold vacuum exceeds eight inches of mercury, the shape of cam lobe 326 permits only slight upward movement of actuating rod 208 to thereby insure that the fuel mixture reaching the engine is rich enough to prevent engine stumbling or stalling. During this time, rod 404 of fast idle system 400 is disposed in full down position thereby causing drive pin 416 to rotate cam 418 in the counter-clockwise direction, as viewed in FIG. 6, thereby overcoming the countervailing action of counterweight 422 so that the end of adjustment screw 420 rests against the highest surface or landing of the cam. As a consequence, engine idle speed is increased over its normal speed when the engine is warm.

If an ambient temperature is above 50° when the engine is started, push rod 310 of engine coolant temperature responsive actuating assembly 302 will have started its upward travel to thereby rotate cam 326 clockwise as viewed in FIGS. 1, 4 and 14 to in turn rotate metering chamber 90 clockwise. As a result, the air-fuel mixture during starting is somewhat leaner than when starting below 50° F., but it is still richer than during warm running.

As the engine warms up, bimetallic spring 356 and push rod 310 both tend to rotate control rod 324 and cam lobe 326 in a clockwise direction as shown in FIGS. 1 and 4, so that the radius of the portion of the cam directed toward roller 328 diminishes to thereby reduce the uplift against the upper roller. This allows metering chamber 90 to pivot in the counter-clockwise direction to thereby produce a leaner air-fuel ratio than during cold start-up. At the same time, the radius of the portion of the cam directed toward roller 330 increases to limit the extent to which metering chamber 90 can rotate in the clockwise direction to thereby prevent the air-fuel ratio from being as rich as during cold start. Also, as the engine continues to warm, eventually clearance will exist between cam lobe 326 and roller 328 thereby permitting vacuum assembly 200 to further lean the air-fuel ratio in response to engine vacuum.

During the engine warm-up, the intake manifold normally heats up faster than the engine coolant, so that bimetallic spring 356 operates earlier than push rod thermostat 305. As a result, bimetallic spring 356 causes control rod 324 to rotate ahead of push rod 310 to thereby lift segment gear 312 upwardly off of contact with push rod 310 until the coolant temperature reaches approximately 90° to 100° F. whereupon thermostat 305 overpowers spring 356.

During initial engine warm-up, only engine coolant from the hottest engine source passes through mixing valve 614, but when the coolant temperature reaches approximately 135° F. to 140° F., valve 614 causes cooled coolant to begin flowing into inlet 620 to mix with the hot coolant. As a result, the temperature of the engine coolant circulating through carburetor 20 is stabilized at approximately 140° F.

Also during engine warm-up, when the coolant temperature passing through carburetor 20 reaches approximately 90° F., the water induction shut-off valve 560 is actuated by the rotation of control member 324 through link 596 to thereby begin induction of water from reservoir 500 into venturi 30. By the time the coolant temperature reaches 100°, the water induction system is in full operation.

Another change which occurs during engine warm-up is that as control rod 324 rotates under the influence of bimetallic coil 356 or push rod 310, rod 404 of fast idle system 400 rises upwardly to draw drive pin 416 away from seat 426 thereby enabling cam 418 to pivot clockwise, as shown in FIG. 6, so that throttle arm 142 can return to its normal low speed idle position.

When the engine reaches its normal operating temperature, the maximum temperature of the engine coolant typically ranges from 185° F. to 200° F. The temperature of the coolant circulating through carburetor coolant circuit 307, however, remains at a constant 140° as controlled by mixing valve 614, as described above. Also, once the engine has fully warmed up, the richest and leanest air-fuel ratio supplied by carburetor 20 is limited by rollers 328 and 330 of rocker arms 336 and 334 bottoming on cam lobe 326, which cam lobe is rotated so that a maximum clearance exists between the cam lobe and upper roller 328 while a minimum clearance exists between the cam lobe and lower roller 330. During high power requirements, such as during hard acceleration when the manifold vacuum level is below eight inches of mercury, vacuum diaphragm assembly 200 is non-operational so that actuating rod 208 is forced downwardly under the force of spring 223 until lower roller 330 bottoms on cam 326. This relatively rich mixture position of rod 208 and chamber 90 is maintained until the vacuum level in the intake manifold exceeds eight inches of mercury. Under cruise conditions, i.e., when the manifold vacuum level is above eight inches of mercury, the force of compression spring 223 is overcome by the vacuum in chamber 218 so that actuating rod 208 is lifted upwardly to thus rotate metering chamber 90 in a clockwise direction until upper roller 328 bottoms on cam 326.

Additional fuel is temporarily supplied to venturi section 30 during rapid movement of throttle arm 142 and thus fast rotation of metering arm 92 through metering chamber 90 to thereby produce an accelerator pump action. Rapid movement of arm 92 through chamber 90 in the direction toward the wider end portion of metering groove 154 increases the pressure of the fuel within rearward section 129B of the metering chamber thereby closing valve 120 to prevent fuel from exiting from the rear section of the chamber. The consequent rise in fuel level and pressure within metering chamber rear section 129B, not only forces an additional volume of fuel into arm inlet 134, but also activates pressure block circuit 166 forcing fuel through pressure block circuit inlet passageway 168 and inlet groove 170 and out outlet passageway 178 to thereby supply additional fuel at increased pressure to inlet opening 134 thus increasing the flow rate of fuel up through metering arm passageway 94. This additional volume of fuel flowing through arm 92 and into venturi 30 almost instantaneously enables the engine to produce additional power when needed, such as during acceleration.

During moderate to slow movement of throttle arm 142, the bleeding of fuel through bleed orifices 122 formed in metering chamber bottom wall 106 will prevent excessive fuel from being forced up through metering arm 92. Also, slow movement of throttle arm 142 will only temporarily and slightly increase the fuel level in metering chamber rear section 129B thereby resulting in only a slight momentary enrichment of the air-fuel mixture within venturi section 30. As a consequence, very high fuel economy is maintained. Moreover, very slow movement of throttle arm 142 will have very little if any effect on the air-fuel mixture as long as metering arm 92 swings slow enough for the fuel level within metering chamber rear section 129B to remain substantially constant.

After the engine is shut down, heat rising upwardly from the engine and intake manifold continues to warm carburetor 20 and tends to cause after-boiling of the fuel within reservoir 50. However, in the present invention, this detrimental phenomena is eliminated by maintaining the carburetor temperature below the boiling temperature of the fuel through the cooperative action of mixing valve 614 and coolant circulation system 660. As the temperature within the carburetor increases to a preselected level after engine shutdown, e.g. 145° F., pump motor 676 is activated by switch 670 to circulate coolant water past mixing valve 614 and through carburetor circuit 307. During this time, mixing valve 614 continues to operate to limit the maximum temperature of the coolant entering circuit 307 to approximately 140° F. Once the coolant temperature level within carburetor 20 lowers back down to approximately 140° F., pump motor 676 automatically switches off until the coolant temperature again rises to above 140° F. This cyclical action will continue until the engine and manifolds cool sufficiently to eliminate after-boiling.

During restart of the engine when still in warm condition, the subsequent cooling of bimetallic coil 356 during the engine shut-off will not cause excessive richening of the air-fuel mixture since as long as the temperature of the engine coolant is approximately 140° F., push rod 310 will maintain cam lobe 326 in its hot running position, as shown in FIG. 4.

Figure 15:
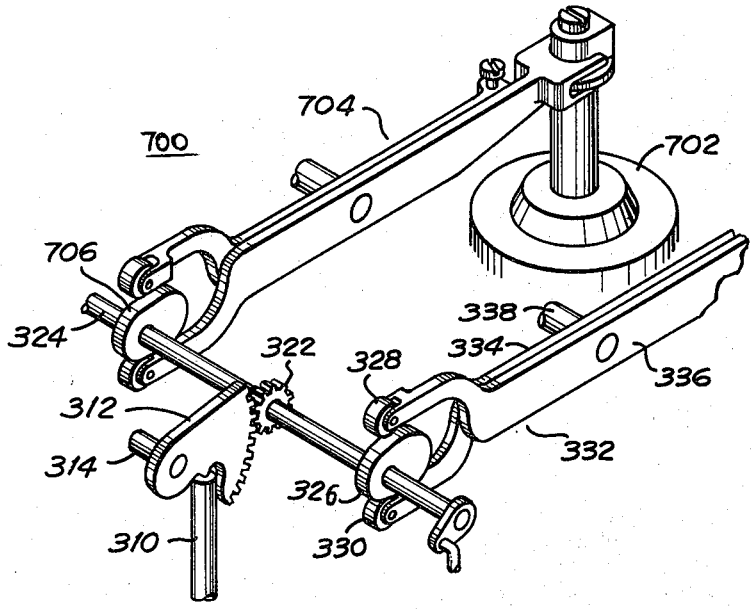
FIG. 15 is a partial schematic view of the fuel flow regulating system of an alternative embodiment of a carburetor constructed according to the present invention.

An alternative embodiment of the present invention is schematically illustrated in FIG. 15, wherein carburetor 700 is especially adapted to utilize two separate, independently combustable fuels at the same time. Carburetor 700 is constructed very similarly to carburetor 20 illustrated in FIGS. 1–14, but with the exception that adjusting rod 510 and shutoff valve 560 of carburetor 20 has been replaced by a second vacuum assembly 702, a second scissors link assembly 704 and a second cam lobe 706 formed very similarly to corresponding scissors link assembly 322 and cam lobe 326 of vacuum assembly 200. Constructing carburetor 700 with these components enables fuel from reservoir 500 to be simultaneously discharged from spray bar 98 with the fuel from reservoir 50. Because the fuel within reservoir 500 is also independently combustable, it is not necessary to wait until the engine has been warmed before introducing the alternative fuel, as is required when water is induced by carburetor 20.

To accommodate a second independently combustable fuel, the width of groove 154 of metering insert 148 and the shape of cam 326 may be altered as may the width of groove 548 of metering insert 544. Moreover, it may be necessary to change the configuration of these components when different types of fuels are used in carburetor 700 to achieve maximum fuel efficiency and engine power.

Figure 16:
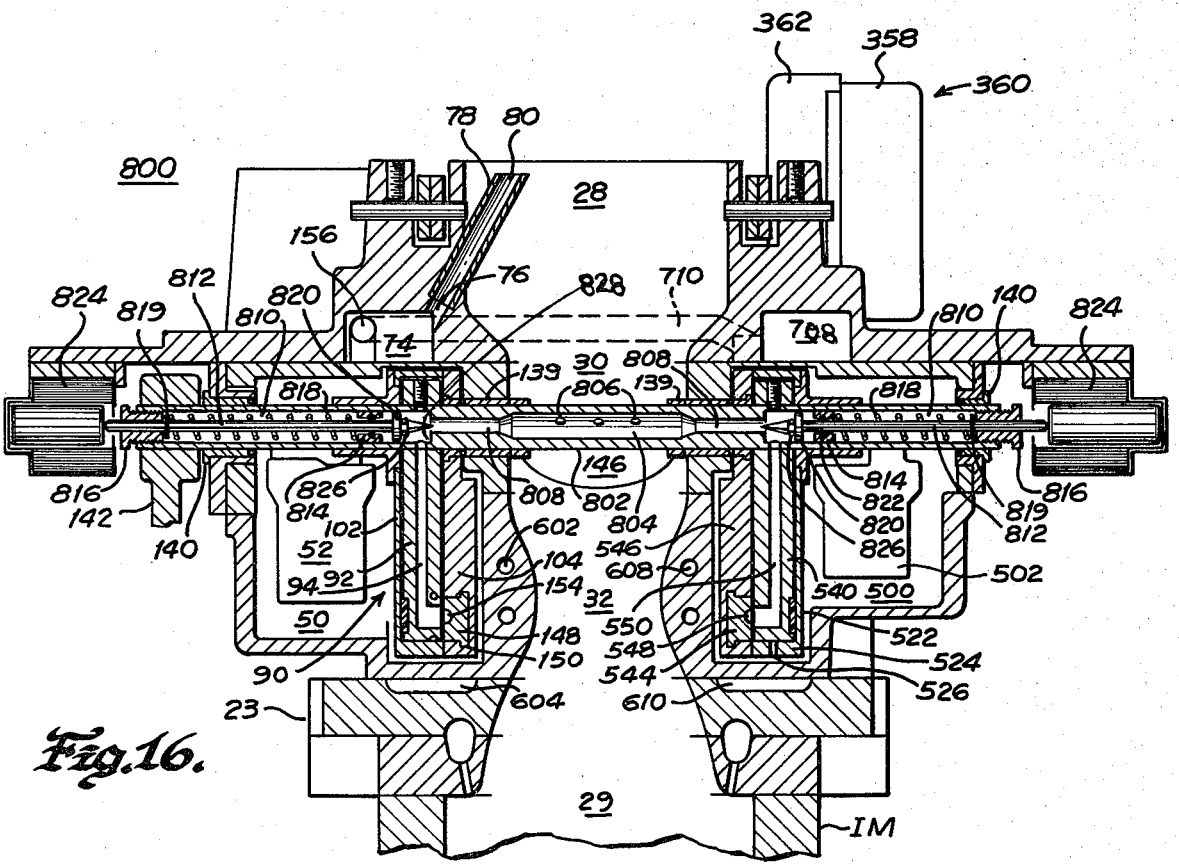
FIG. 16 is a rear cross-sectional view of a further typical embodiment of a carburetor constructed according to the present invention specifically illustrating the construction of the spray bar.

One additional difference between carburetor 700 and carburetor 20 is that in carburetor 700 both reservoirs 50 and 500 are vented to air horn 28 together. As best shown in FIG. 16, which illustrates another of alternative carburetor embodiments 800 having a similar vent system, reservoir 500 includes a vent chamber 708 which is interconnected through carburetor body passageway 710 to bore 158 which houses the plunger of solenoid recirculation valve 164. As a consequence, when the engine is running, passageway 710 is in communication with carburetor vapor passageway 156 leading to bore 158 from vent cavity 74 of reservoir 50. Accordingly, when the engine is shut down, solenoid valve 164 vents both reservoirs 50 and 500 to a charcoal canister, not shown.

Figure 11A:
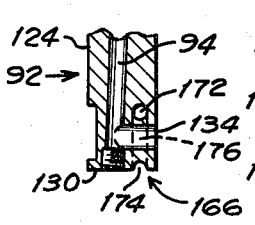
FIGS. 11A and 11B are fragmentary cross-sectional views of the fuel metering arm illustrated in FIG. 11 taken along lines 11A—11A and along lines 11B—11B, respectively, thereof.
Figure 11B:
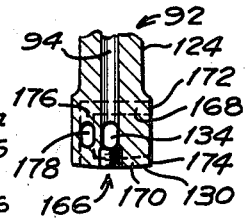

Also, unlike the situation in carburetor 20 wherein water metering chamber 508 does not include a spring valve for inlet port 527 or a pressure block circuit in metering arm 540 to prevent any accelerator pumping action, in carburetor 700, an accelerator pumping action is desirable for both fuels. Thus, a spring valve is included with inlet port 527, FIG. 10, and a pressure block circuit, similar to circuit 166 of arm 92, FIGS. 11, 11A and 11B, is formed in arm 540.

The opertion of carburetor 700 is essentially the same as that of carburetor 20, as described above, with the exception that fuel from reservoir 500 is induced into the engine at all times that the engine is running, in a manner similar to the induction of fuel from reservoir 50. Thus it is to be appreciated that carburetor 700 also provides the advantages over conventional carburetors provided by carburetor 20, as discussed above.

A further embodiment of the present invention is illustrated in FIG. 16, wherein a carburetor 800, similar in construction and operation to carburetor 700, is specially designed to utilize two independently combustible fuels, one at a time, rather than simultaneously as in carburetor 700. Similar to the construction of carburetor 700, carburetor 800 also includes a second vacuum assembly 702, scissors link assembly 704 and cam 706 in conjunction with the delivery of fuel from reservoir 500. Moreover, the manner of venting vapors from reservoir 500 is identical to that used in carburetor 700, as is the construction of metering chamber 508 and metering arm 540.

To deliver fuel from reservoirs 50 and 500 one at a time, spray bar 98 of carburetors 20 and 700 has been replaced by spray bar 802 of alternative design. As with spray bar 98, spray bar 802 extends transversely through the upper portions of fuel chambers 50 and 500, being journaled within sleeve bearings 139 pressed in the wall separating the fuel reservoirs from venturi 30 and flange bearings 140, mounted on the outer walls of the two reservoirs. Spray bar 802 includes a variably-shaped hollow central passageway extending along its length composed of a central section 804 having crossed drilled holes 806 for discharge of the fuels, reduced diameter intermediate sections 808 extending outwardly from each side of central section 804 and enlarged diameter out sections 810 extending outwardly from intermediate section 808 to the ends of the spray bar. An elongate plunger 812 is disposed within each spray bar outer section 810 to slide within a short sleeve 814 pressed within outer section 810 near its intersection with intermediate section 808 and within nut 816 adjustably engaged with the threaded inside diameter of the end portions of spray bar 802. A compression spring 818, held captive between sleeve 814 and a snap ring 819 engages with plunger 812 adjacent adjusting nut 816, serves to retract the plunger in nominally open position away from corresponding intermediate section 808 so that a circular flange 820 disposed at the end of the plunger inwardly adjacent sleeve 814, bottoms or approaches the end of sleeve 814 opposite spring 818. An O-ring 822 is disposed within an interior groove formed within sleeve 814 to engage around the circumference of plunger 812 to prevent fuel from leaking outwardly or air leaking inwardly through the inside diameter of the sleeve.

To prevent fuel in reservoirs 50 and 500 from reaching spray bar central portion 804, plungers 812 are pushed inwardly toward the center of spray bar 802 by solenoids 824 so that an O-ring 826, engaged over the plunger adjacent the side of flange 820 opposite sleeve 814 seats against a shoulder 828 formed by the intersection of spray bar intermediate outer sections 808 and 810, respectively. As a consequence, fuels rising upwardly through the interiors of metering arms 92 and 540 are alternatively prevented from entering spray bar intermediate sections 808. The leading end of each plunger is tapered in the shape of a cone to serve as a needle valve to adjust the maximum rate at which fuel is allowed to enter the spray bar during high power operation by selectively varying the engagement of adjusting nut 816 with the end of the spray bar. An electrical switch, not shown, is provided to alternatively energize the two solenoid valves so that only fuel from one reservoir 50 or 500 enters spray bar 802 at a time.

In an alternative manner of operating plungers 812, solenoids 824 may be replaced with pressure diaphragms, not shown, which press against the ends of plungers 812 in response to the pressure of the fuel entering the opposite reservoir. Thus, when fuel is being supplied to one reservoir, the plunger 812 of the opposite reservoir will be pushed inwardly to prevent fuel from flowing from the opposite reservoir. This manner of operating plungers 812 necessitates the use of two electric fuel pumps, not shown, one for each reservoir 50 and 500.

It is to be understood that as with carburetor 700, the components of carburetor 800 may be conveniently and economically replaced to accommodate the particular types of fuels being utilized. For instance, metering inserts 148 and 544 may be replaced with inserts having grooves of varying configurations and widths. Also, the shape of cams 326 and 706 may be changed to vary the maximum richness and leanness of the fuel-air mixture and also to alter the extent to which vacuum assemblies 200 and 702 are permitted to change the air-fuel ratios of the two fuels.

In operation, carburetor 800 is essentially identical to that of carburetor 700 with the exception that fuel from only one reservoir 50 or 500 at a time is discharged from spray bar 802. Thus, all of the advantages of carburetor 700 are provided by carburetor 800. Moreover, by limiting induction of only one type of fuel at a time into venturi section 30, a relatively volatile fuel, such as gasoline, can be utilized during startup and cold running. However, after the engine has sufficiently warmed, a less volatile, but perhaps more economical or more pollution-free fuel such as alcohol may be utilized.

As will be apparent to those skilled in the art to which the invention is addressed, the present invention may be embodied in forms or embodiments other than those specifically disclosed above, without departing from the spirit or essential characteristics of the invention. The particular embodiments of the carburetors 20, 700 and 800 described above are therefore to be considered in all respects as illustrative, and not restrictive, i.e. the scope of the present invention is set forth in the appended claims rather than being limited to the examples of the carburetors 20, 700 and 800 set forth in the foregoing description.

What is claimed is:

1. An improved carburetor for a liquid cooled internal combustion engine having an intake manifold, the carburetor having an air horn, a venturi section, a throat and a throttle valve disposed within the venturi section, with the improvement comprising:

(a) a spray bar rotatable on an axis extending transversely across the venturi section for rotatably supporting the throttle valve within the venturi section, said spray bar having at least one internal passageway extending along the length of said spray bar and having a plurality of openings in communication with said passageway;

(b) a first liquid reservoir;

(c) first liquid delivery means for conveying a first liquid from said first liquid reservoir to said spray bar internal passageway, said first liquid delivery means including first, flow regulating means for regulating the flow rate of the first liquid through said first liquid fuel delivery means in response to the rotational orientation of said spray bar;

(d) vacuum actuated second flow regulating means for regulating the flow rate of the first liquid through said first liquid delivery means in response to the level of manifold vacuum;

(e) thermally activated third flow regulating means for regulating the flow rate of the first liquid through said first liquid delivery means in response to both engine coolant temperature and intake manifold temperature, said third flow regulating means operating in series with said second flow regulating means, and restraining the capacity of said second flow regulating means to vary the rate of flow of the first fuel based on the temperature of the engine coolant and the intake manifold;

(f) a second liquid reservoir;

(g) second liquid delivery means for conveying a second liquid from said second liquid reservoir to said spray bar internal passageway, said second liquid delivery means including fourth flow regulating means for varying the flow rate of the second liquid through said second liquid delivery means in response to the rotational orientation of said spray bar; and (h) fifth flow regulating means for varying the flow rate of the second liquid through said second liquid delivery means in response to engine temperature.

2. The improvement according to claim 1, further including liquid switching means to alternatively interconnect in liquid flow communication said first liquid delivery means or said second liquid delivery means with said spray bar passageway.

3. The improvement according to claim 2, wherein:

said spray bar includes a pair of inlet openings in communication with the spray bar passageway; and said liquid switching means includes a first valve disposed within a first spray bar inlet opening, a second valve disposed within the second spray bar inlet opening and actuator means for actuating said two spray bar valves to alternatively open one of said two spray bar valves while closing the other spray bar valve.

4. The improvement according to calim 3, wherein said spray bar inlet openings are disposed at opposite ends of said spray bar passageway.

5. The improvement according to claim 3, wherein said actuating means includes a first movable actuating member disposed in liquid pressure communication with the first liquid, said first actuating member movable in response to the pressure of the first liquid to actuate said second liquid passage valve to block said passageway opening corresponding to said second liquid when the first liquid reaches a predetermined pressure; and a second movable actuating member disposed in liquid pressure communication with the second liquid, said second actuating member movable in response to the pressure of the second liquid to actuate said first liquid passageway valve to close off the passageway opening corresponding to the first liquid when the second liquid reaches a predetermined pressure.

6. The improvement according to claim 1, wherein said spray bar includes:

a first internal passageway in liquid flow communication with said first liquid delivery means and terminating at a first set of liquid discharge openings; and a second internal passageway in liquid flow communication with said second liquid delivery means and terminating at a second set of liquid discharge openings.

7. The improvement according to claim 1, wherein:
said first liquid delivery means includes:
a substantially enclosed first liquid metering chamber disposed pivotally within and in liquid flow communication with said first liquid reservoir, and
a first liquid metering arm disposed pivotally within said first metering chamber to pivit in response to the pivoting movement of said spray bar, said first metering arm including an internal liquid passageway having an inlet in liquid flow communication with said first metering chamber and an outlet in liquid flow communication with said spray bar passageway; and
said first flow regulating means includes means for regulating the rate of liquid flow between said first metering chamber and said first metering arm passageway inlet based on the angular position of said first metering arm within said first metering chamber.

8. The improvement according to claim 7, wherein said first metering arm is mounted on said spray bar to pivot therewith.

9. The improvement according to claims 8 or 7, wherein said first metering chamber is suspended from said spray bar.

10. The improvement according to claim 7, wherein:
said first regulating means includes a first metering insert removably insertable within said first metering chamber, said first insert defining an arcuate groove of variable width and depth disposed about a center corresponding to the longitudinal axis of said spray bar;
said first liquid metering arm being elongate and extending transversely from said spray bar; and
said first metering arm liquid passageway inlet opening is formed within said first metering arm at a location closely adjacent to said insert groove, said opening facing said first insert groove to sweep an arc extending along the arc defined by said first insert groove to thereby vary the width of said first insert arc addressing said first spray bar passageway opening in response to the angular position of said first metering arm with said first metering chamber.

11. The improvement according to claim 10, wherein said first liquid delivery means including means for temporarily increasing the flow rate of the first liquid through said first metering arm fuel passageway as a function of the speed with which said first metering arm pivots relative to said first metering chamber.

12. The improvement according to claim 7 or 10, wherein said first liquid delivery means includes means for preventing excess liquid from flowing through said first metering arm passageway during moderate to slow movement of said first metering arm relative to said first metering chamber.

13. The improvement according to claim 12, wherein said first metering chamber includes two spaced apart side walls disposed on opposite sides of said first metering arm and an arcuate bottom wall interconnecting said two side walls and formed in an arc slightly larger than the arc defined by the end portion of said first metering arm opposite said spray bar as said first metering arm pivots relative to said first metering chamber, said bottom wall including a plurality of pressure bleed orifices spaced therealong to allow liquid to exit from said first metering chamber.

14. The improvement according to claim 7, wherein said third flow regulating means includes:
a movable control member;
linkage means for interconnecting said control member with said first liquid metering chamber;
a first temperature responsive actuating assembly adapted to sense engine coolant temperature and shift said control member in response to the engine coolant temperature;
a second temperature responsive actuating assembly adapted to sense intake manifold temperature and shift said control member in response to engine manifold temperature; and
means operated by said control member for limiting the capacity of said second flow regulating means to vary the rate of flow of the first liquid through said first liquid delivery means.

15. The improvement according to claim 7, wherein said second flow regulating means includes a vacuum diaphragm assembly interconnected in fluid flow communication with the intake manifold, said vacuum assembly including an actuating rod interconnected with said first liquid metering chamber, said actuating rod being longitudinally movable in response to the vacuum level within said intake manifold to thereby pivot said first metering chamber relative to said first metering arm to thereby vary the rate of the first liquid flow through said first metering arm passageway.

16. The improvement according to claim 15, wherein said third flow regulating means includes:
a shiftable control member;
linkage means interconnecting said shiftable control member with said vacuum diaphragm assembly;
limiter means carried by said shiftable control member to selectively control the movement of said linkage means based on the position of said shiftable control member;
a first temperature responsive actuating assembly adapted to sense engine coolant temperature, said first actuating assembly interconnected with said shiftable control member to shift said control member and thereby limit movement of said vacuum diaphragm actuating rod in response to engine coolant temperature; and
a second temperature responsive actuating assembly adapted to sense intake manifold temperature, said second actuating assembly interconnected with said shiftable control member to shift said control member and thereby limit the movement of said vacuum diaphragm actuating rod in response to intake manifold temperature.

17. The improvement according to claim 16, further including means for utilizing engine coolant to both warm said carburetor to a predetermined temperature and limit the temperature of the engine coolant sensed by said first temperature responsive actuating assembly of said third flow regulating means.

18. The improvement of claim 17, wherein:
said carburetor warming and coolant temperature limiting means includes a mixing valve in fluid flow communication with said first temperature responsive actuating assembly, said mixing valve having a first inlet port for receiving engine coolant from a location corresponding to approximately the warmest portion of the engine coolant, a second inlet port for receiving engine coolant from a location corresponding to approximately the coolest portion of the engine coolant, and a thermally activated spool for varying the relative volume of engine coolant permitted to pass through said valve from said first and second inlet ports to thereby limit the maximum temperature of the engine coolant flowing through said valve.

19. The improvement according to claim 18, wherein said coolant temperature limiting means further includes a heat exchanger disposed upstream and in fluid flow communication with the second inlet port of said mixing valve to thereby further cool the engine coolant entering said mixing valve from approximately the coolest portion of the engine coolant.

20. The improvement according to claim 16, wherein: said second liquid delivery means includes;

a substantially enclosed second liquid metering chamber disposed pivotally within and in liquid flow communication with said second liquid reservoir; and a second liquid metering arm disposed pivotally within said second metering chamber to pivot in response to the pivoting movement of said spray bar, said second metering arm including an internal liquid passageway having an inlet in communication with said second metering chamber and an outlet in communication with said spray bar passageway; and said fourth regulating means includes means for varying the rate of flow of the second liquid between said second metering chamber and said second metering arm passageway inlet as a function of the rotational position of said second metering arm within said second metering chamber.

21. The improvement according to claim 20, wherein said fifth flow regulating means comprises:

a high pressure ventilation circuit interconnecting the upper portion of said liquid reservoir with the air horn at a location upstream from the throttle valve;

a low pressure ventilation circuit for interconnecting the upper end portion of said second liquid reservoir with the throat at a location downstream from the throttle valve;

a shutoff valve;

thermally activated means for switching said shutoff valve between a first position opening said low pressure ventilation circuit and closing said high pressure vent circuit, and a second position closing said low pressure vent circuit and opening said high pressure vent circuit.

22. The improvement according to claim 21, wherein said switching means is thermally activated to switch said shutoff valve when the engine reaches a preselected temperature.

23. The improvement according to claim 21, wherein: said valve includes a body portion having a first outlet opening in communication with said low pressure circuit, a second outlet opening in communication with said high pressure circuit, an inlet opening in communication with an upper portion of said second liquid reservoir, and a spool disposed within said housing to switch between a first position interconnecting said housing first outlet with said housing inlet and closing said housing second outlet, and a second position interconnecting said housing second outlet with said housing inlet and closing said housing first outlet; and said switching means includes linkage means interconnecting said spool with said control member.

24. The improvement according to claim 20, further including sixth flow regulating means having a second vacuum diaphragm assembly disposed in fluid flow communication with the intake manifold and including a second actuating rod interconnected with said second liquid metering chamber, said second actuating rod longitudinally movable in response to the vacuum level in the intake manifold to thereby pivot said second metering chamber relative to said second metering arm.

25. The improvement according to claim 24, wherein said fifth flow regulating means includes:

second linkage means interconnected with said second vacuum diaphragm assembly actuating rod; and second limiter means carried by said control member to interconnect said second linkage means with said control member to selectively limit the movement of said second linkage means based on the position of said control member.

26. The improvement according to claim 1, wherein: said second liquid delivery means includes;

a substantially enclosed second liquid metering chamber disposed pivotally and in liquid flow communication with said second liquid reservoir, and a second liquid metering arm disposed pivotally within said second metering chamber to pivot in response to the pivoting movement of said spray bar, said second metering arm having an internal liquid passageway having an inlet in communication with said second metering chamber and an outlet in communication with said spray bar passageway; and said fourth flow regulating means includes means for governing the rate of liquid flow between said second metering chamber and said second metering arm passageway inlet as a function of the rotational position of said second metering arm within said second metering chamber.

27. The improvement according to claim 26, wherein said second metering arm is pivotally mounted on said spray bar to pivot therewith.

28. The improvement according to claims 25 or 26, wherein said second metering chamber is pivotally suspended from said spray bar.

29. The improvement according to claim 26, wherein: said fourth flow regulating means includes a second metering insert removably mounted within said second metering chamber, said second insert defining an arcuate groove of variable width and depth disposed about a center corresponding to the longitudinal axis of said spray bar;

said second metering arm being elongate and extending transversely from said spray bar; and said second metering arm liquid passageway inlet is located at a location along the length of said second metering arm to sweep an arc corresponding to the arc defined by said second insert groove, said second metering arm passageway inlet faces and is in close adjacency to said second insert groove to thereby slide along said second insert groove in liquid flow communication therewith as said second metering arm pivots within said second metering chamber to thereby vary the width of said second insert groove addressing said second metering arm passageway inlet.

30. The improvement according to claim 29, wherein said second liquid delivery means further includes means for temporarily increasing the flow rate of the second liquid through said second metering arm liquid passageway as a function of the speed with which said second metering arm pivots relative to said second metering chamber.

31. The improvement according to claim 26, further comprising sixth flow regulating means including a second vacuum diaphragm assembly interconnected in fluid flow communication with the intake manifold, said second vacuum assembly including an actuating rod interconnected with said second metering chamber, said second actuating rod longitudinally movable in response to the vacuum level within the intake manifold to thereby pivot said second metering chamber relative to said second metering arm.

32. The improvement according to claim 31, wherein said fifth flow regulating means includes second linkage means interconnecting with said second vacuum diaphragm assembly actuating rod; and second limiter means powered by said second and third flow regulating means to selectively limit the movement of said second linkage means based on the temperature of engine coolant fluid and the temperature of the inlet manifold.

33. The improvement according to claim 26, wherein said fifth flow regulating means includes second linkage means interconnected with said second metering chamber to pivot said second metering chamber relative to said second metering arm; and second limiter means powered by said second and third flow regulating means to selectively shift said second linkage means and thereby pivot said second metering chamber relative to said second metering arm in response to the temperature of the engine coolant and the temperature of said intake manifold.

34. The improvement according to claim 26, wherein said fifth flow regulating means includes:

a low pressure ventilation circuit having an outlet in the throat at a location slightly downstream from the throttle valve and an inlet in an upper portion of said second liquid reservoir;

a high pressure ventilation circuit having an outlet in the air horn at a location upstream from the throttle valve and an inlet in an upper portion of said second liquid reservoir; and a shutoff valve adapted to shift between a first position to open said low pressure circuit and block said high pressure circuit when the engine temperature is below a predetermined level; and a second position to block said low pressure circuit and open said high pressure circuit when the engine temperature is above said predetermined level.

35. The improvement according to claim 34, wherein said fifth flow regulating means includes means interconnecting said shutoff valve with said third flow regulating means whereby the switching of said shutoff valve between first and second position is controlled by said third flow regulating means.

36. The improvement according to claim 1, wherein the portion of the throat disposed downstream of the throttle valve is substantially constant in cross-sectional area while assuming constantly varying cross-sectional shapes along the length of the throat.

37. The improvement according to claim 36, wherein in cross section the portion of the throat located below the throttle valve sequentially transitions into a plurality of oblong sections spaced along the length of the throat with adjacently located oblong sections being disposed transversely to each other.

38. The improvement according to claim 37, wherein the portion of the throat disposed between adjacently located oblong sections is substantially circular in cross section.

39. The improvement according to claim 1:

wherein the carburetor includes a body portion composed of a plurality of internal passageways in fluid flow communication with both a first engine coolant source corresponding to approximately the hottest portion of the engine coolant and a second engine coolant source corresponding to approximately the coolest portion of the engine coolant; and further including means for modulating the proportion of and mixing engine coolant entering said carburetor internal passageways from said first and second engine coolant sources to limit the maximum temperature of said engine coolant circulating through said carburetor internal passageways.

40. The improvement according to claim 39, further including means for continuing the circulation of engine coolant through said carburetor internal passageways after the engine ceases operation when the temperature of the coolant within said carburetor internal passageways reaches a preselected level.

41. The improvement according to claim 1, utilizing engine coolant to rapidly increase the temperature of said carburetor to a preselected maximum temperature including:

a coolant passageway extending through the carburetor, said passageway having an inlet and an outlet; and a thermally controlled coolant mixing valve in communication with said carburetor passageway inlet, said mixing valve having a first inlet port for receiving engine coolant from a location corresponding to approximately the warmest source of engine coolant, a second inlet port for receiving engine coolant from a location corresponding to approximately the coolest source of engine coolant, and thermally controlled means for modulating the relative volume of engine coolant permitted to enter said valve from said first and second inlet ports to restrict the maximum temperature of the engine coolant mixture flowing through said valve and into said carburetor passageways.

42. The improvement according to claim 41, wherein said carburetor warming means further includes a heat exchanger disposed upstream and in fluid flow communication with the second inlet port of said mixing valve to further cool the engine prior to entering said mixing valve.

43. For use with an internal combustion engine having an intake manifold, an improved carburetor for supplying two dissimilar fuels to the engine, said carburetor having an air horn, a venturi section, a throat and a throttle valve disposed within the venturi section, with the improvement comprising:

(a) first and second fuel reservoirs disposed on opposite sides of the throat for receiving first and second fuels, respectively, therein;

(b) a spray bar extending transversely through the venturi section and transversely through at least a portion of said two fuel reservoirs, said spray bar;

rotatable about its longitudinal axis, supporting said throttle valve for rotational movement within the venturi section, having at least one internal passageway extending along its length, and having a plurality of fuel discharge openings in communication with said internal passageway;

(c) a first fuel metering chamber disposed within said first fuel reservoir, said first metering chamber suspended from said spray bar and connected in fuel flow communication with said first fuel reservoir;

(d) a first metering arm mounted on said spray bar to pivot within said first metering chamber in response to the movement of said spray bar, said first metering arm including an internal fuel passageway in communication with said first metering chamber and with said spray bar passageway;

(e) first flow regulating means for regulating the flow rate of the first fuel passing through metering arm passageway in response to the rotational orientation of said spray bar;

(f) second flow regulating means for regulating the flow rate of the first fuel through said first metering arm passageway in response to the level of manifold vacuum;

(g) third flow regulating means for regulating the flow rate of the first fuel through said first metering arm passageway in response to both engine coolant temperature and manifold temperature, said third flow regulating means operating in tandem with said second flow regulating means and variably controlling the operation range of said second flow regulating means as a function of the temperature of both the engine coolant and the intake manifold;

(h) a second fuel metering chamber disposed within said second fuel reservoir, said second metering chamber suspended from said spray bar and connected in fuel flow communication with said second fuel reservoir;

(i) a second metering arm mounted on said spray bar to pivot within said second metering chamber in response to the movement of said spray bar, said second metering arm including an internal fuel passageway in communication with said second metering chamber and with said spray bar passageway;

(j) fourth flow regulating means for regulating the flow rate of the second fuel through said second metering arm passageway in response to the rotational orientation of said spray bar; and (k) fifth flow regulating means regulating the flow rate of the second fuel through said second metering arm passageway in response to engine temperature.

44. The improvement according to claim 43, wherein said second flow regulating means includes a vacuum diaphragm assembly adapted to sense intake manifold vacuum, said vacuum assembly interconnected with said first fuel metering chamber to pivot said first fuel metering chamber about said spray bar and relative to said first metering arm in response to the vacuum level within the intake manifold to thereby vary the rate of flow of the first fuel through said first metering arm passageway.

45. The improvement according to claim 44, wherein said third flow regulating means includes:

linkage means interconnected with said vacuum diaphragm assembly;

cam means adapted to rotate about a center to variably control the movement of said linkage means based on the rotational position of said cam means;

a first actuating assembly adapted to sense engine coolant temperature, said first actuating assembly interconnected with said cam means to rotate said cam means about its center in response to engine coolant temperature; and a second actuating assembly adapted to sense intake manifold temperature, said second actuating assembly interconnected with said cam means to rotate said cam means about its center in response to intake manifold temperature.

46. The improvement according to claim 43, wherein said third flow regulating means includes:

a first movable control member;

linkage means for interconnecting said movable control member with said first metering chamber;

a first actuating assembly adapted to sense engine coolant temperature, said first actuating assembly interconnected with said movable control member to shift said control member in response to the engine coolant temperature to thereby pivot said first metering chamber about said spray bar and relative to said first metering arm; and a second actuating assembly adapted to sense intake manifold temperature, said second actuating assembly interconnected with said cam to rotate said cam in response to the temperature of the intake manifold to thereby pivot said first metering chamber about said spray bar and relative to said first metering arm.

47. The improvement according to claim 43, wherein said fifth flow regulating means comprises:

a low pressure ventilation circuit having an outlet in the throat at a location slightly downstream from the throttle valve and an inlet in an upper portion of said second fuel reservoir;

a high pressure ventilation circuit having an outlet in the air horn at a location upstream from the throttle valve and an inlet in an upper portion of said second fuel reservoir; and a thermally activated shutoff valve adapted to shift between a first position to open said low pressure circuit and block said high pressure circuit to thereby subject the upper portion of said second fuel reservoir to a pressure level low enough to prevent fuel from flowing through said second metering arm passageway, and a second position to block said low pressure circuit and open said high pressure circuit when the engine temperature has risen above a predetermined level to thereby subject the upper portion of said second fuel reservoir to a pressure high enough to permit fuel from said second reservoir to flow through said second metering arm passageway.

48. The improvement according to claim 47, wherein said fifth flow regulating means includes linkage means interconnecting said shutoff valve with said third flow regulating means whereby the shifting of said shutoff valve between first and second position is controlled by said third flow regulating means.

49. The improvement according to claim 43, further comprising sixth flow regulating means including a second vacuum diaphragm assembly disposed in fluid flow communication with the intake manifold and interconnected with said second metering chamber to pivot said second metering chamber about said spray bar and said second metering arm in response to the vacuum level in the intake manifold.

50. The improvement according to claim 49, wherein said fifth flow regulating means includes:

second linkage means interconnected with said second vacuum diaphragm assembly;

second cam means adapted to rotate about a center to control the movement of said second linkage means and thereby control the pivoting movement of said second metering chamber about said spray bar; and means for interconnecting said second cam with said third flow regulating means whereby the rotation of said cam is governed by said third flow regulating means.

51. In an improved carburetor for an internal combustion engine having an intake manifold, the carburetor having an air horn; a throat; a spray bar rotatable on an axis extending transversely across the throat for rotatably supporting a throttle valve within the throat, the spray bar having an internal longitudinally extending passageway and a plurality of outlet openings in communication with the passageway; and a fuel reservoir, with the improvement comprising:

a substantially enclosed liquid metering chamber disposed within the fuel reservoir and pivotally suspended from the spray bar;

a fuel metering arm disposed pivotally within said metering chamber to pivot with the rotational movement of the spray bar, said metering arm including an internal fuel passageway in fuel flow communication with the metering chamber and with the spray bar passageway;

adjustable first flow regulating means for regulating the rate of fuel flow through said metering arm passageway in response to the angular position of said metering arm within said metering chamber;

vacuum actuated second flow regulating means for varying the angular orientation of the metering chamber about the spray bar to thereby regulate the flow rate of the fuel through the spray bar passageway in response to the level of intake manifold vacuum; and thermally activating third flow regulating means for regulating the flow rate of fuel through said metering arm passageway in response to both engine coolant temperature and intake manifold temperature, said third flow regulating means:

operating in series with said second flow regulating means to vary the angular position of said metering chamber about said spray bar, and controlling the operating range of said second flow regulating means on the basis of the temperature of the engine coolant and the intake manifold.

52. The improvement according to claim 51, wherein said second flow regulating means includes a vacuum diaphragm assembly interconnected in fluid flow communication with the intake manifold, said vacuum assembly including an actuating rod linked at one of its ends with said metering chamber, said actuating rod being longitudinally movable in response to the vacuum level within said intake manifold to thereby pivot said metering chamber relative to said metering arm to thus alter the rate of fuel flow through said metering arm passageway.

53. The improvement according to claim 52, wherein said third flow regulating means includes:

linkage means interconnected with said second flow regulating means;

cam means adapted to rotate about a center to variably control the movement of said linkage means based on the rotational position of said cam means;

a first actuating assembly adapted to sense engine coolant temperature, said first actuating assembly interconnected with said cam means to rotate said cam means about its center in response to engine coolant temperature; and a second actuating assembly adapted to sense intake manifold temperature, said second actuating assembly interconnected with said cam means to rotate said cam means about its center in response to intake manifold temperature.

* * * * *

UNITED STATES PATENT OFFICE

CERTIFICATE OF CORRECTION

Patent No. 4,340,549 Dated July 20, 1982

Inventor(s) Robert E. McKim

It is certified that error appears in the above-identified patent and that said Letters Patent are hereby corrected as shown below:

Column 19, line 55, change "through" to -- though --.

Column 26, line 41, change "calim" to -- claim --.

Column 26, line 49, change "passage" to -- passageway --.

Column 27, line 7, change "pivit" to -- pivot --.

Signed and Sealed this

Ninth Day of November 1982

[SEAL]

*Attest:*

GERALD J. MOSSINGHOFF

*Attesting Officer* *Commissioner of Patents and Trademarks*